US008839640B2

(12) United States Patent
Yamashita et al.

(10) Patent No.: US 8,839,640 B2
(45) Date of Patent: Sep. 23, 2014

(54) AIR-CONDITIONING APPARATUS

(75) Inventors: Koji Yamashita, Tokyo (JP); Yuji Motomura, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 190 days.

(21) Appl. No.: 13/498,332

(22) PCT Filed: Oct. 27, 2009

(86) PCT No.: PCT/JP2009/068404

§ 371 (c)(1),
(2), (4) Date: Mar. 27, 2012

(87) PCT Pub. No.: WO2011/052038

PCT Pub. Date: May 5, 2011

(65) Prior Publication Data

US 2012/0180513 A1 Jul. 19, 2012

(51) Int. Cl.

| | |
|---|---|
| ***F25B 13/00*** | (2006.01) |
| ***F25B 25/00*** | (2006.01) |
| *F25B 5/04* | (2006.01) |

(52) U.S. Cl.

CPC ..... *F25B 13/00* (2013.01); *F25B 2313/006* (2013.01); *F25B 5/04* (2013.01); *F25B 2313/0272* (2013.01); *F25B 2313/02741* (2013.01); *F25B 25/005* (2013.01)

USPC ..... 62/324.1; 62/324.6

(58) Field of Classification Search

CPC ..... F25B 13/00; F25B 5/04; F25B 2313/006; F25B 25/005; F25B 2313/02741; F25B 2313/0272

USPC ..... 62/238.7, 238.6, 324.6, 228.3, 324.1

See application file for complete search history.

(56) References Cited

U.S. PATENT DOCUMENTS

| | | | | |
|---|---|---|---|---|
| 2,311,224 | A * | 2/1943 | Gould | 62/243 |
| 2,752,759 | A * | 7/1956 | Sperzel | 62/159 |
| 3,159,211 | A * | 12/1964 | Miner | 165/233 |
| 4,694,658 | A * | 9/1987 | Juhola | 62/100 |
| 6,405,551 | B1 * | 6/2002 | Kuwabara et al. | 62/238.7 |
| 8,522,552 | B2 * | 9/2013 | Waterstripe et al. | 60/670 |
| 2004/0168446 | A1 * | 9/2004 | Taira et al. | 62/84 |
| 2006/0032623 | A1 * | 2/2006 | Tsubone et al. | 165/202 |
| 2008/0022710 | A1 * | 1/2008 | Jeong et al. | 62/324.6 |

(Continued)

FOREIGN PATENT DOCUMENTS

| | | | |
|---|---|---|---|
| JP | 5-280818 | A | 10/1993 |
| JP | 9-170828 | A | 6/1997 |

(Continued)

OTHER PUBLICATIONS

Translation of JP 2002-106995 to Umeda et al.*

(Continued)

*Primary Examiner* — Mohammad M Ali

(74) *Attorney, Agent, or Firm* — Buchanan Ingersoll & Rooney PC

(57) ABSTRACT

To provide an air-conditioning apparatus capable of achieving energy saving.

The air-conditioning apparatus capable of executing an oil collection mode that collects a refrigerating machine oil stagnating in heat exchangers related to heat medium into a compressor by changing a flow velocity or a flow direction of the refrigerant flowing in the heat exchangers related to heat medium depending on each operation mode.

14 Claims, 14 Drawing Sheets

(56) References Cited

U.S. PATENT DOCUMENTS

| | | | | |
|---|---|---|---|---|
| 2008/0202722 | A1* | 8/2008 | Feuerecker et al. | 165/41 |
| 2008/0236189 | A1 | 10/2008 | Honda et al. | |
| 2008/0302113 | A1* | 12/2008 | Yin et al. | 62/115 |

FOREIGN PATENT DOCUMENTS

| | | | |
|---|---|---|---|
| JP | 2001-65928 | A | 3/2001 |
| JP | 2001-289465 | A | 10/2001 |
| JP | 2002-106995 | A | 4/2002 |
| JP | 2003-343936 | A | 12/2003 |
| JP | 2005-140444 | A | 6/2005 |
| JP | 2005-326068 | A | 11/2005 |
| JP | 2006-46779 | A | 2/2006 |
| JP | 2007-309538 | A | 11/2007 |

OTHER PUBLICATIONS

Japanese Office Action (Notice of Reasons for Rejection) dated May 7, 2013, issued in corresponding Japanese Patent Application No. 2011-538139, and English language translation of Office Action. (7 pages).

Office Action (Notice of Reasons for Refusal) issued on Sep. 3, 2013, by the Japanese Patent Office in corresponding Japanese Patent Application No. 2011-538139, and an English Translation of the Office Action. (7 pages).

International Search Report (PCT/ISA/210) issued on Jan. 26, 2010, by Japanese Patent Office as the International Searching Authority for International Application No. PCT/JP2009/068404.

* cited by examiner (a) CASE WITHOUT CONSIDERATION OF PRESSURE LOSS IN EVAPORATOR (b) CASE IN CONSIDERATION OF PRESSURE LOSS IN EVAPORATOR (a) CASE WHERE HEAT EXCHANGER IS USED AS CONDENSER OR GAS COOLER (b) CASE WHERE HEAT EXCHANGER IS USED AS EVAPORATOR

AIR-CONDITIONING APPARATUS

TECHNICAL FIELD

The present invention relates to an air-conditioning apparatus that is applied to, for example, a multi-air-conditioning apparatus for a building.

BACKGROUND ART

In an air-conditioning apparatus such as a multi-air-conditioning apparatus for a building, a refrigerant is circulated between an outdoor unit, which is a heat source unit disposed, for example, outside a building, and indoor units disposed in rooms in the building. The refrigerant transfers heat or removes heat to heat or cool air, thus heating or cooling a conditioned space through the heated or cooled air. Hydrofluorocarbon (HFC) refrigerants are often used as the refrigerant, for example. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

Moreover, there is an air-conditioning apparatus called a heat recovery chiller that connects a heat source unit to each indoor unit with four water pipings arranged therebetween, supplies cooled and heated water or the like simultaneously, and allows the cooling and heating in the indoor units to be selected freely (refer to Patent Literature 2, for example).

In addition, there is an air-conditioning apparatus that disposes a heat exchanger for a primary refrigerant and a secondary refrigerant near each indoor unit in which the secondary refrigerant is carried to the indoor unit (refer to Patent Literature 3, for example).

Furthermore, there is an air-conditioning apparatus that connects an outdoor unit to each branch unit including a heat exchanger with two pipings in which a secondary refrigerant is carried to an indoor unit (refer to Patent Literature 4, for example).

CITATION LIST

Patent Literature

Patent Literature 1: Japanese Unexamined Patent Application Publication No. 2005-140444 (page 4, FIG. 1, etc.)

Patent Literature 2: Japanese Unexamined Patent Application Publication No. 5-280818 (pages 4 and 5, FIG. 1, etc.)

Patent Literature 3: Japanese Unexamined Patent Application Publication No. 2001-289465 (pages 5 to 8, FIG. 1, FIG. 2, etc.)

Patent Literature 4: Japanese Unexamined Patent Application Publication No. 2003-343936 (page 5, FIG. 1)

SUMMARY OF INVENTION

Technical Problem

In an air-conditioning apparatus of a related art, such as a multi-air-conditioning apparatus for a building, there is a possibility of refrigerant leakage to, for example, an indoor space because the refrigerant is circulated to an indoor unit.

On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be carried to the indoor unit side. Accordingly, a circulation path of the heat medium is long. In this case, carrying of heat for a predetermined heating or cooling work using the heat medium consumes more amount of energy, in the form of conveyance power and the like, than the amount of energy consumed by the refrigerant. As the circulation path becomes longer, therefore, the conveyance power becomes markedly large. This indicates that energy saving can be achieved in an air-conditioning apparatus if the circulation of the heat medium can be controlled well.

In the air-conditioning apparatus disclosed in Patent Literature 2, the four pipings connecting the outdoor side and the indoor need to be arranged in order to allow cooling or heating to be selected in each indoor unit. Disadvantageously, there is little ease of construction. In the air-conditioning apparatus disclosed in Patent Literature 3, a secondary medium circulating device such as a pump needs to be provided to each indoor unit. Disadvantageously, the system is not only costly but also has large noise, and is not practical. In addition, since the heat exchanger is disposed near each indoor unit, the risk of refrigerant leakage to a place near an indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units is connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

The present invention has been made to overcome the above-described problem and provides an air-conditioning apparatus capable of achieving energy saving. The invention further provides an air-conditioning apparatus capable of achieving improvement of safety by not allowing refrigerant to circulate in or near an indoor unit. The invention further provides an air-conditioning apparatus that reduces the number of pipings connecting an outdoor unit to a branch unit (heat medium relay unit) or the branch unit to an indoor unit, and improves ease of construction as well as improving energy efficiency.

Solution to Problem

An air-conditioning apparatus according to the invention includes a compressor, a heat source side heat exchanger, a plurality of expansion devices, a plurality of heat exchangers related to heat medium, a plurality of pumps, and a plurality of use side heat exchangers, in which a refrigerant circuit circulating a refrigerant that contains a refrigerating machine oil therein is formed by connecting the compressor, the heat source side heat exchanger, the expansion devices, and the heat exchangers related to heat medium with a refrigerant piping, a plurality of heat medium circuits circulating a heat medium are formed by connecting the pumps, the use side heat exchangers, and the heat exchangers related to heat medium. The air-conditioning apparatus is capable of executing a heating only operation mode that heats the heat medium by making the high-temperature high-pressure refrigerant that has been discharged from the compressor flow into all of the heat exchangers related to heat medium, a cooling only operation mode that cools the heat medium by making the low-temperature low-pressure refrigerant flow into all of the heat exchangers related to heat medium, a cooling and heating mixed operation mode that heats the heat medium by making the high-temperature high-pressure refrigerant that has been discharged from the compressor flow into one or some of the heat exchangers related to heat medium and cools the heat medium by making the low-temperature low-pressure refrigerant flow into one or some of the remaining heat exchangers related to heat medium, and an oil collection mode that collects the refrigerating machine oil stagnating in the heat exchangers related to heat medium into the compressor by changing a flow velocity or a flow direction of the refrigerant flowing in the heat exchangers related to heat medium depending on each operation mode.

Advantageous Effects of Invention

The present invention is capable of shortening the pipings in which the heat medium circulates and requires small conveyance power, and thus is capable of saving energy. Further, the refrigerating machine oil stagnating in the heat exchanger related to heat medium can be collected into the compressor.

DESCRIPTION OF EMBODIMENT

Embodiment of the invention will be described below with reference to the drawings.

Figure 1:
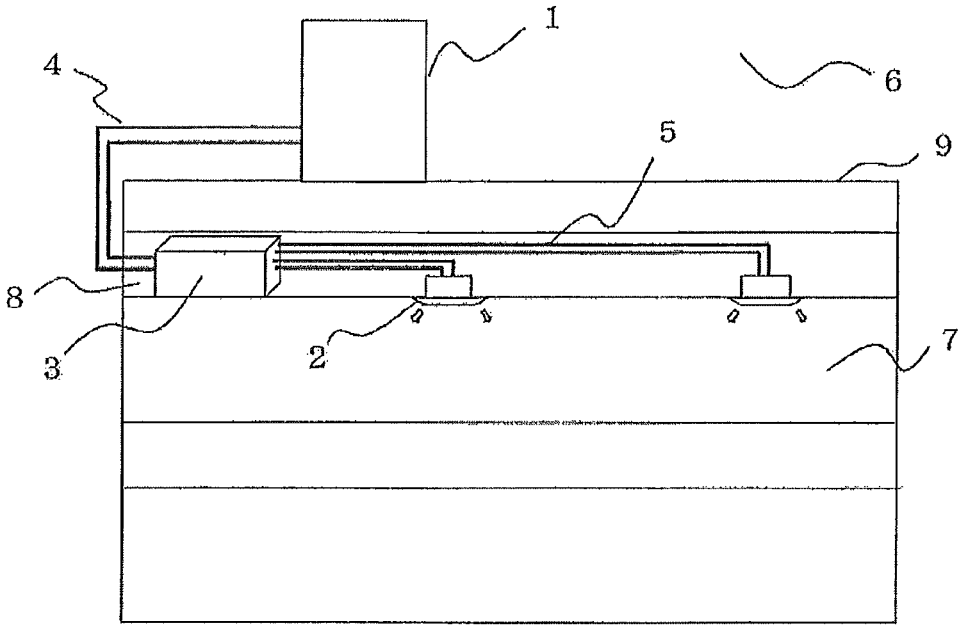
FIG. 1 is a schematic diagram illustrating an exemplary installation of an air-conditioning apparatus according to Embodiment of the invention.
Figure 2:
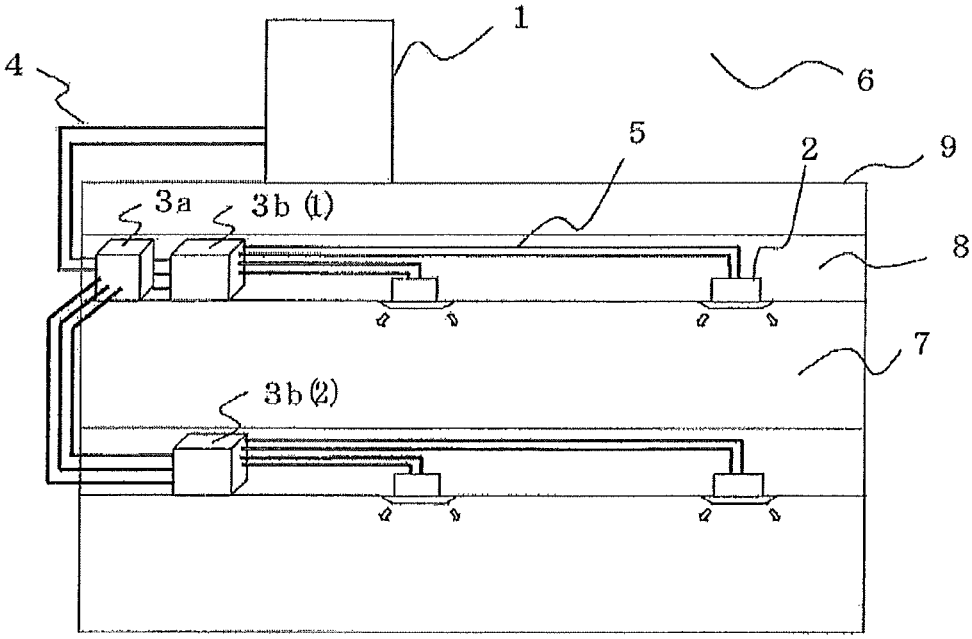
FIG. 2 is a schematic diagram illustrating an exemplary installation of an air-conditioning apparatus according to Embodiment of the invention.

FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. This air-conditioning apparatus uses refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipings 4 through which the heat source side refrigerant flows. The heat medium relay unit 3 and each indoor unit 2 are connected with pipings 5 (heat medium pipings) through which the heat medium flows. Cooling energy or heating energy generated in the outdoor unit 1 is delivered through the heat medium relay unit 3 to the indoor units 2.

Referring to FIG. 2, the air-conditioning apparatus according to Embodiment includes a single outdoor unit 1, a plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipings 4. The main heat medium relay unit 3*a* and the sub heat medium relay units 3*b* are connected with the refrigerant pipings 4. Each sub heat medium relay unit 3*b* and each indoor unit 2 are connected with the pipings 5. Cooling energy or heating energy generated in the outdoor unit 1 is delivered through the main heat medium relay unit 3*a* and the sub heat medium relay units 3*b* to the indoor units 2.

The outdoor unit 1 is typically disposed in an outdoor space 6, which is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is a space (e.g., a living room) inside the structure 9, and supplies the cooling air or heating air to the indoor space 7, that is, to a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipings 4 and is connected to the indoor units 2 through the pipings 5 to convey cooling energy or heating energy, supplied from the outdoor unit 1 to the indoor units 2.

As illustrated in FIGS. 1 and 2, in the air-conditioning apparatus according to Embodiment, the outdoor unit 1 is connected to the heat medium relay unit 3 using two refrigerant pipings 4, and the heat medium relay unit 3 is connected to each indoor unit 2 using two pipings 5. As described above, in the air-conditioning apparatus according to Embodiment, each of the units (the outdoor unit 1, the indoor units 2, and the heat medium relay unit 3) is connected using two pipings (the refrigerant pipings 4 or the pipings 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant piping 4 connecting the main heat medium relay unit 3*a* to each sub heat medium relay unit 3*b* is three. Detail of this circuit will be described in detail later (refer to FIG. 3A).

Furthermore, FIGS. 1 and 2 illustrate a state where each heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, e.g., a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

Figure 3:
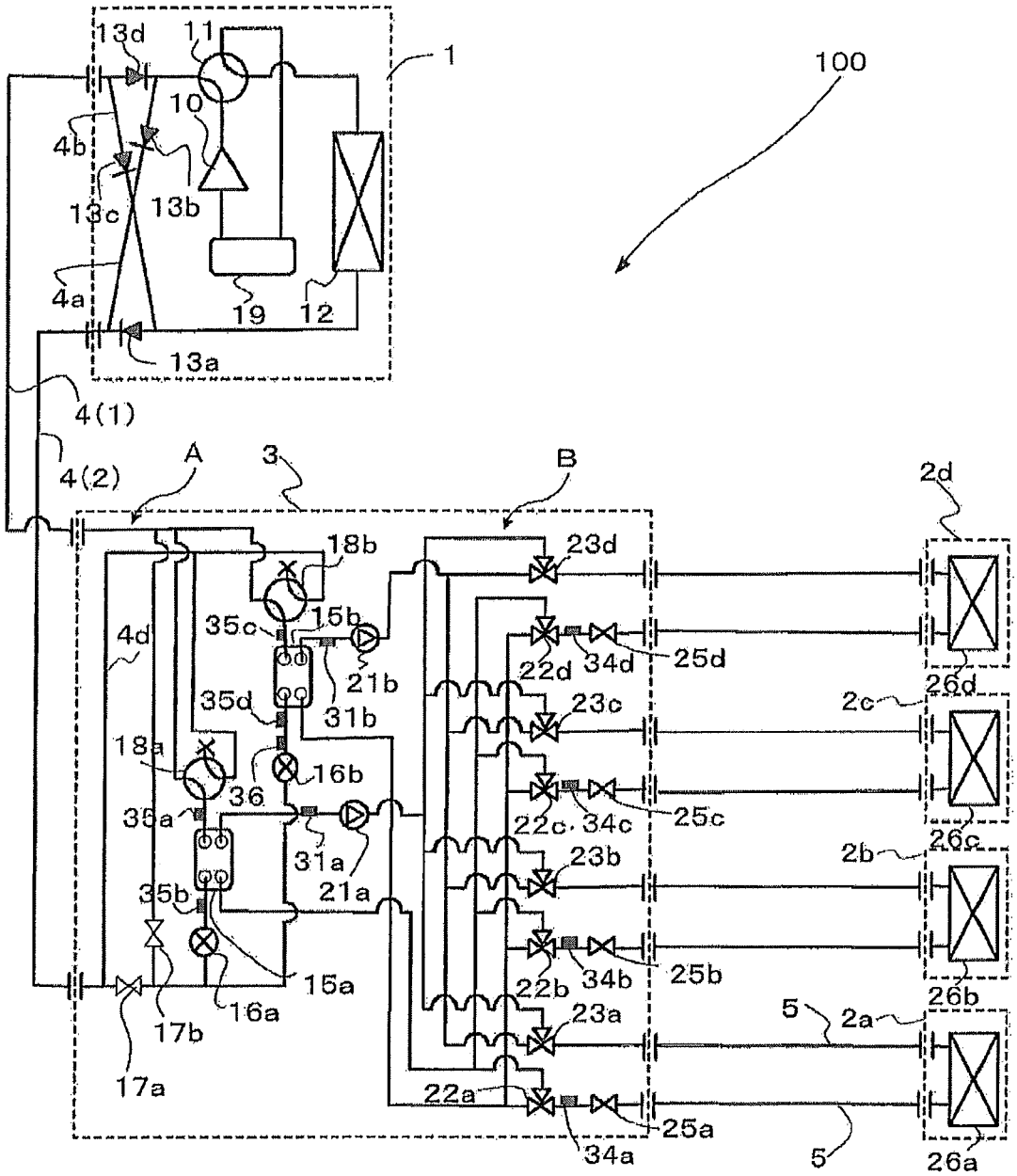
FIG. 3 is a schematic circuit diagram illustrating an exemplary circuit configuration of the air-conditioning apparatus according to Embodiment of the invention.

FIG. 3 is a schematic circuit diagram illustrating an exemplary circuit configuration of the air-conditioning apparatus (hereinafter, referred to as an "air-conditioning apparatus 100") according to Embodiment of the invention. The detailed configuration of the air-conditioning apparatus 100 will be described with reference to FIG. 3. As illustrated in FIG. 3, the outdoor unit 1 and the heat medium relay unit 3 are connected with the refrigerant pipings 4 through heat exchangers related to heat medium 15*a* and 15*b* included in the heat medium relay unit 3. Furthermore, the heat medium relay unit 3 and the indoor units 2 are connected with the pipings 5 through the heat exchangers related to heat medium 15*a* and 15*b*.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by any indoor unit 2.

The compressor 10 sucks the heat source side refrigerant and compress the heat source side refrigerant to a high-temperature, high-pressure state. The compressor 10 may include, for example, a capacity-controllable inverter compressor. The first refrigerant flow switching device 11 switches the flow of the heat source side refrigerant between a heating operation (heating only operation mode and heating main operation mode) and a cooling operation (cooling only operation mode and cooling main operation mode). The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporate and gasify or condense and liquefy the heat source side refrigerant. The accumulator 19 is disposed on the suction side of the compressor 10 and stores excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and allows the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. It should be noted that FIG. 3 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they may be omitted.

[Indoor Units 2]

The indoor units 2 each include a use side heat exchanger 26. The use side heat exchanger 26 is connected to a heat medium flow control device 25 and a second heat medium flow switching device 23 in the heat medium relay unit 3 with the pipings 5. Each of the use side heat exchanger 26 exchanges heat between air supplied from an air-sending device, such as a fan, (not illustrated) and the heat medium in order to produce heating air or cooling air to be supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIGS. 1 and 2, the number of connected indoor units 2 illustrated in FIG. 3 is not limited to four.

[Heat Medium Relay Unit 3]

The heat medium relay unit 3 includes the two heat exchangers related to heat medium 15, two expansion devices 16, two on-off devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 3A.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in a refrigerant circuit A and is used to heat the heat medium in the heating only operation mode and is used to cool the heat medium in the cooling only operation mode, the cooling main operation mode, and the heating main operation mode. The heat exchanger related to heat medium 15*a* is disposed between an expansion device 16*a* and a second refrigerant flow switching device 18*a* in a refrigerant circuit A and is used to heat the heat medium in the heating only operation mode and is used to cool the heat medium in the cooling only operation mode, the cooling main operation mode, and the heating main operation mode.

The two expansion devices 16 (the expansion device 16*a* and the expansion device 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, e.g., an electronic expansion valve.

The two on-off devices 17 (an on-off device 17*a* and an on-off device 17*b*) each include, for example, a two-way valve and open or close the refrigerant piping 4. The on-off device 17*a* is disposed in the refrigerant piping 4 on the inlet side of the heat source side refrigerant. The opening and closing device 17*b* is disposed in a piping connecting the refrigerant piping 4 on the inlet side of the heat source side refrigerant and the refrigerant piping 4 on an outlet side thereof. The two second refrigerant flow switching devices 18 (second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat medium 15*a*, downstream regarding the heat source side refrigerant flow during the cooling operation. The second refrigerant flow switching device 18*b* is disposed downstream of the heat exchanger related to heat medium 15*b*, downstream regarding the heat source side refrigerant flow during the cooling only operation.

The two pumps 21 (pump 21*a* and pump 21*b*), serving as heat medium sending devices, circulate the heat medium flowing through the piping 5: The pump 21*a* is disposed in the piping 5 between the heat exchanger related to heat medium 15*a* and the second heat medium flow switching devices 23. The pump 21*b* is disposed in the piping 5 between the heat exchanger related to heat medium 15*b* and the second heat medium flow switching devices 23. Each of the two pumps 21 may include, for example, a capacity-controllable pump. Note that the pump 21*a* may be provided in the piping 5 between the heat exchanger related to heat medium 15*a* and the first heat medium flow switching devices 22. Furthermore, the pump 21*b* may be provided in the piping 5 between the heat exchanger related to heat medium 15*b* and the first heat medium flow switching devices 22.

The four first heat medium flow switching devices 22 (first heat medium flow switching devices 22*a* to 22*d*) each include, for example, a three-way valve and switches passages of the heat medium. The first heat medium flow switching devices 22 are arranged so that the number thereof (four in this case) corresponds to the installed number of indoor units 1. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the heat medium flow control device 25. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve using a stepping motor, for example, and is capable of controlling the area of opening of the piping 5, which is the flow passage of the heat medium. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2.

Note that the Embodiment will describe a case in which each heat medium flow control device 25 is disposed on the outlet side (on the downstream side) of the corresponding use side heat exchanger 26 but the arrangement is not limited to this case. Each heat medium flow control device 25 may be disposed on the inlet side (on the upstream side) of the use side heat exchanger 26 such that one way is connected to the use side heat exchanger 26 and the other way is connected to the second heat medium flow switching device 23.

The heat medium relay unit 3 includes various detecting devices (two first temperature sensors 31, four second temperature sensors 34, four third temperature sensors 35, and a pressure sensor 36). Information (temperature information and pressure information) detected by these detecting devices are transmitted to a controller (not illustrated) that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching by the second refrigerant flow switching devices 18, and switching of passages of the heat medium.

Each of the two first temperature sensors 31 (a first temperature sensor 31*a* and a first temperature sensor 31*b*) detects the temperature of the heat medium flowing out of the heat exchanger related to heat medium 15, namely, the heat medium at an outlet of the heat exchanger related to heat medium 15 and may include, for example, a thermistor. The first temperature sensor 31*a* is disposed in the piping 5 on the inlet side of the pump 21*a*. The first temperature sensor 31*b* is disposed in the piping 5 on the inlet of the pump 21*b*.

Each of the four second temperature sensors 34 (second temperature sensor 34*a* to second temperature sensor 34*d*) is disposed between the first heat medium flow switching device 22 and the heat medium flow control device 25 and detects the temperature of the heat medium flowing out of the use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat medium 15 and detects the temperature of the heat source side refrigerant flowing into the heat exchanger related to heat medium 15, or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-sending, device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow direction switching devices 23, and the driving of each heat medium flow control device 25 on the basis of the information detected by the various detecting devices and an instruction from a remote control to carry out the operation modes which will be described later. Note that the controller may be provided to each unit, or may be provided to the outdoor unit 1 or the heat medium relay unit 3.

The pipings 5 in which the heat medium flows include the pipings connected to the heat exchanger related to heat medium 15*a* and the pipings connected to the heat exchanger related to heat medium 15*b*. Each piping 5 is branched (into four in this case) in accordance with the number of indoor units 2 connected to the heat medium relay unit 3. The pipings 5 are connected by the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 and whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat medium 15*a*, the expansion devices 16, and the accumulator 19 are connected through the refrigerant piping 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

As the heat medium, a single phase liquid that does not change into two phases, gas and liquid, while circulating in the heat medium circulation circuit B is used. For example, water or antifreeze solution is used.

Figure 3A:
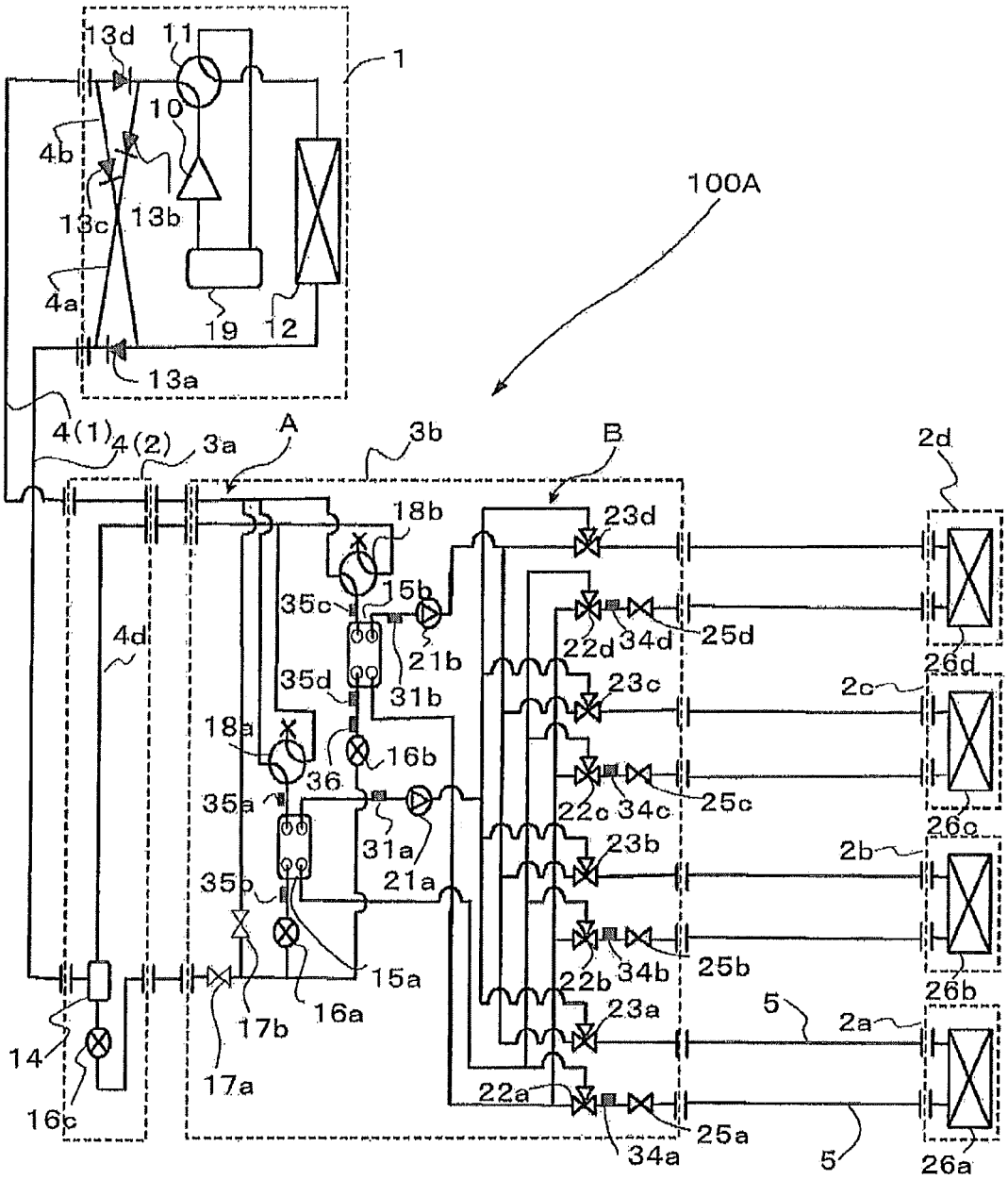
FIG. 3A is a schematic circuit diagram illustrating an exemplary circuit configuration of an air-conditioning apparatus according to Embodiment of the invention.

FIG. 3A is another schematic circuit diagram illustrating an exemplary circuit configuration of the air-conditioning apparatus (hereinafter, referred to as an "air-conditioning apparatus 100A") according to Embodiment of the invention. The configuration of the air-conditioning apparatus 100A in a case in which a heat medium relay unit 3 is separated into a main heat medium relay unit 3*a* and a sub heat medium relay unit 3*b* will be described with reference to FIG. 3A. As illustrate in FIG. 3A, a housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant piping 4 connected to an outdoor unit 1 and is connected to two refrigerant pipings 4 connected to a heat exchanger related to heat medium 15*a* and a heat exchanger related to heat medium 15*b* in the sub heat medium relay unit 3*b*, and is configured to separate heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and reduces the pressure of and expands the heat source side refrigerant. During a cooling and heating mixed operation, the expansion device 16*c* is controlled such that the pressure in an outlet of the expansion device 16*c* is at a medium state. The expansion device 16*c* may include a component having a variably controllable opening degree, such as an electronic expansion valve. This arrangement allows a plurality of sub heat medium relay units 3*b* to be connected to the main heat medium relay unit 3*a*.

Various operation modes executed by the air-conditioning apparatus 100 will be described below. The air-conditioning apparatus 100 allows each indoor unit 2, based on an instruction from the indoor unit 2, to perform a cooling operation or heating operation. Specifically, the air-conditioning apparatus 100 allows all of the indoor units 2 to perform the same operation and also allows each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode which is a cooling and heating mixed operation mode in which cooling load is larger, and a heating main operation mode which is a cooling and heating mixed operation mode in which heating load is larger. The operation modes will be described below with respect to the flow of the heat source side refrigerant and that of the heat medium.

[Cooling Only Operation Mode]

Figure 4:
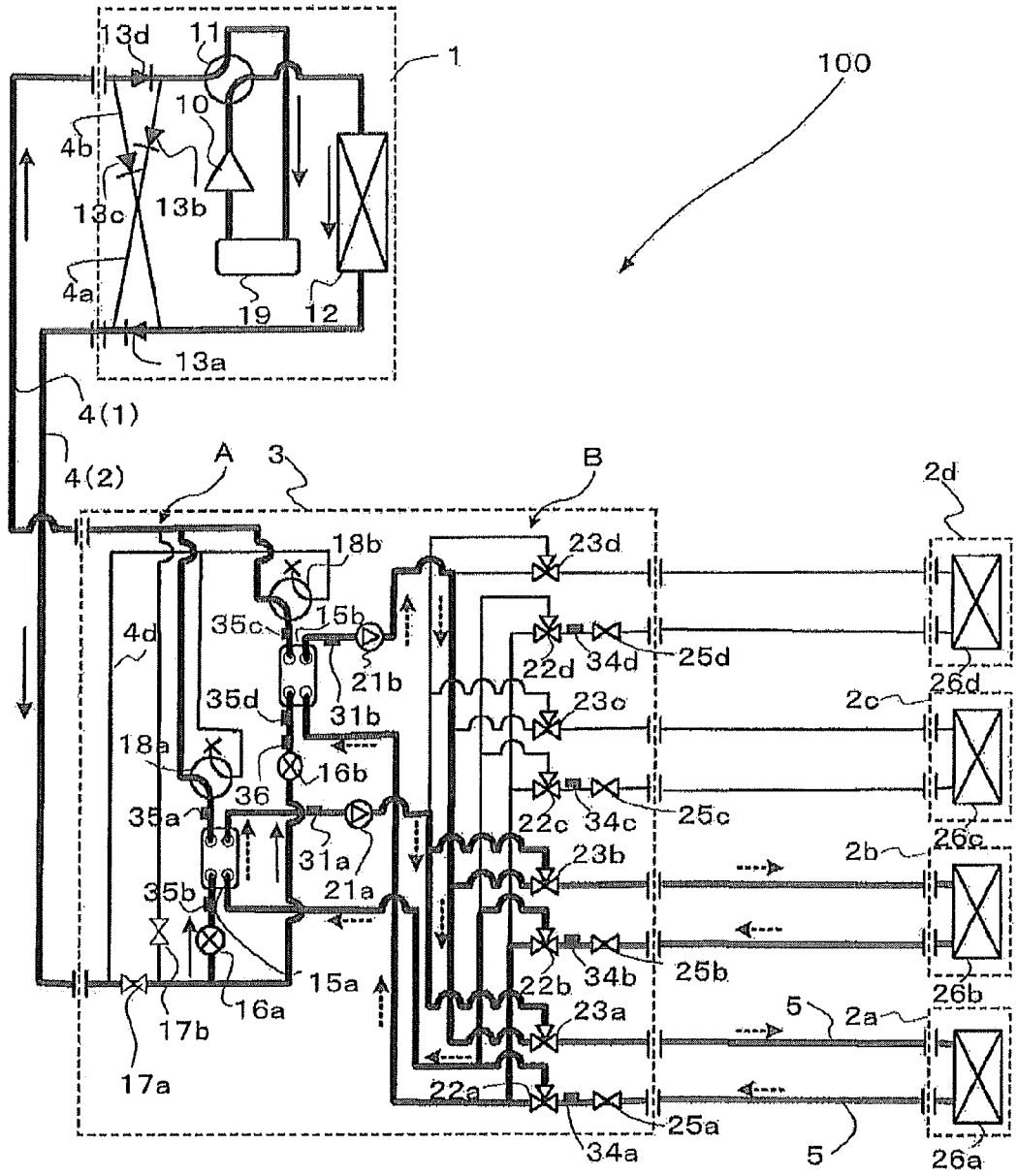
FIG. 4 is a refrigerant circuit diagram illustrating flows of refrigerants in a cooling only operation mode of the air-conditioning apparatus according to Embodiment of the invention.

FIG. 4 is a refrigerant circuit diagram illustrating the flows of refrigerants in the cooling only operation mode of the air-conditioning apparatus 100. The cooling only operation mode will be described with respect to a case in which a cooling load is generated only in a use side heat exchanger 26*a* and a use side heat exchanger 26*b* in FIG. 4. Furthermore, in FIG. 4, pipings indicated by thick lines correspond to pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 4.

In the cooling only operation mode illustrated in FIG. 4, in the outdoor unit 1, a first refrigerant flow switching device 11 is switched such that the heat source side refrigerant discharged from a compressor 10 flows into a heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through a check valve 13*a*, flows out of the outdoor unit 1, passes through the refrigerant piping 4, and flows into the heat medium relay unit 3. The high-pressure liquid refrigerant flowing into the heat medium relay unit 3 is branched after passing through an on-off device 17*a* and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b*, functioning as evaporators, removes heat from the heat medium circulating in a heat medium circuit B to cool the heat medium, and thus turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding one of a second refrigerant flow switching device 18*a* and a second refrigerant flow switching device 18*b*, passes through the refrigerant piping 4, and again flows into the outdoor unit 1. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by a third temperature sensor 35*c* and that detected by a third temperature sensor 35*d*. In addition, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cooling the indoor space 7.

The heat medium then flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 4, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 5:
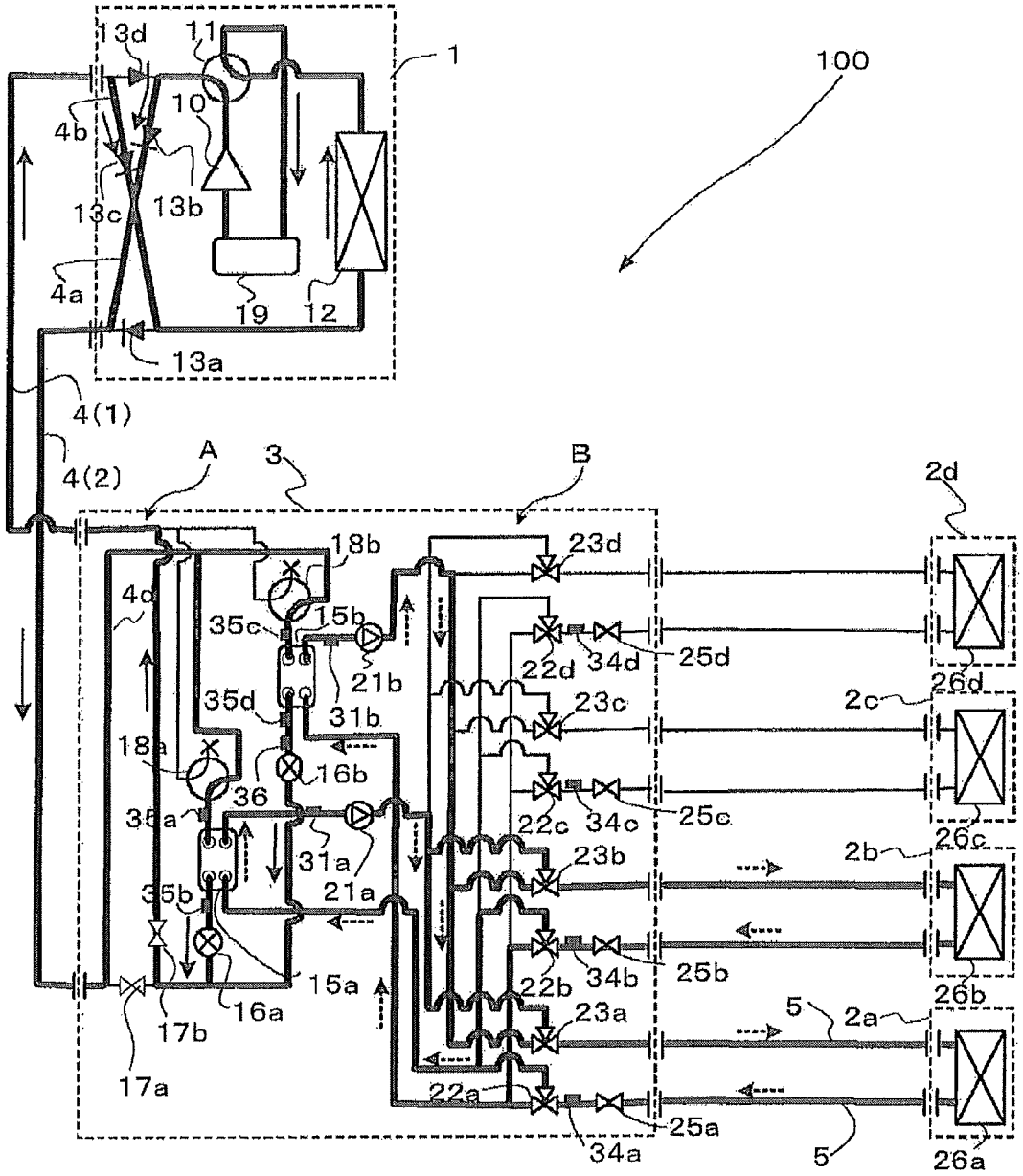
FIG. 5 is a refrigerant circuit diagram illustrating flows of refrigerants in a heating only operation mode of the air-conditioning apparatus according to Embodiment of the invention.

FIG. 5 is a refrigerant circuit diagram illustrating the flows of refrigerants in the heating only operation mode of the air-conditioning apparatus 100. The heating only operation mode will be described with respect to a case in which a heating load is generated only in the use side heat exchanger 26*a* and the use side heat exchanger 26*b* in FIG. 5. Furthermore, in FIG. 5, pipings indicated by thick lines correspond to pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 5.

In the heating only operation mode illustrated in FIG. 5, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant, which has flowed out of the outdoor unit 1, passes through the refrigerant piping 4 and flows into the heat medium relay unit 3. The high-temperature high-pressure gas refrigerant that has flowed into to heat medium relay unit 3 is branched, passes through each of the second refrigerant flow switching device 18*a* and the second refrigerant flow switching device 18*b*, and flows into the corresponding one of the heat exchanger related to heat medium 15*a* and the heat exchanger related to heat medium 15*b*.

The high-temperature high-pressure gas refrigerant flowing into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant through the expansion device 16*a* and the expansion device 16*b*. This two-phase refrigerant passes through the on-off device 17*b*, flows out of the heat medium relay unit 3, passes through the refrigerant piping 4, and again flows into the outdoor unit 1. The refrigerant flowing into the outdoor unit 1 flows through the second connecting piping 4*b*, passes through the check valve 13*c*, and flows into the heat source side heat exchanger 12, functioning as an evaporator.

Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, the subcooling being obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air through each of the use side heat exchanger 26*a* and the use side heat exchanger 26*b*, thus heating the indoor space 7.

The heat medium then flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 6:
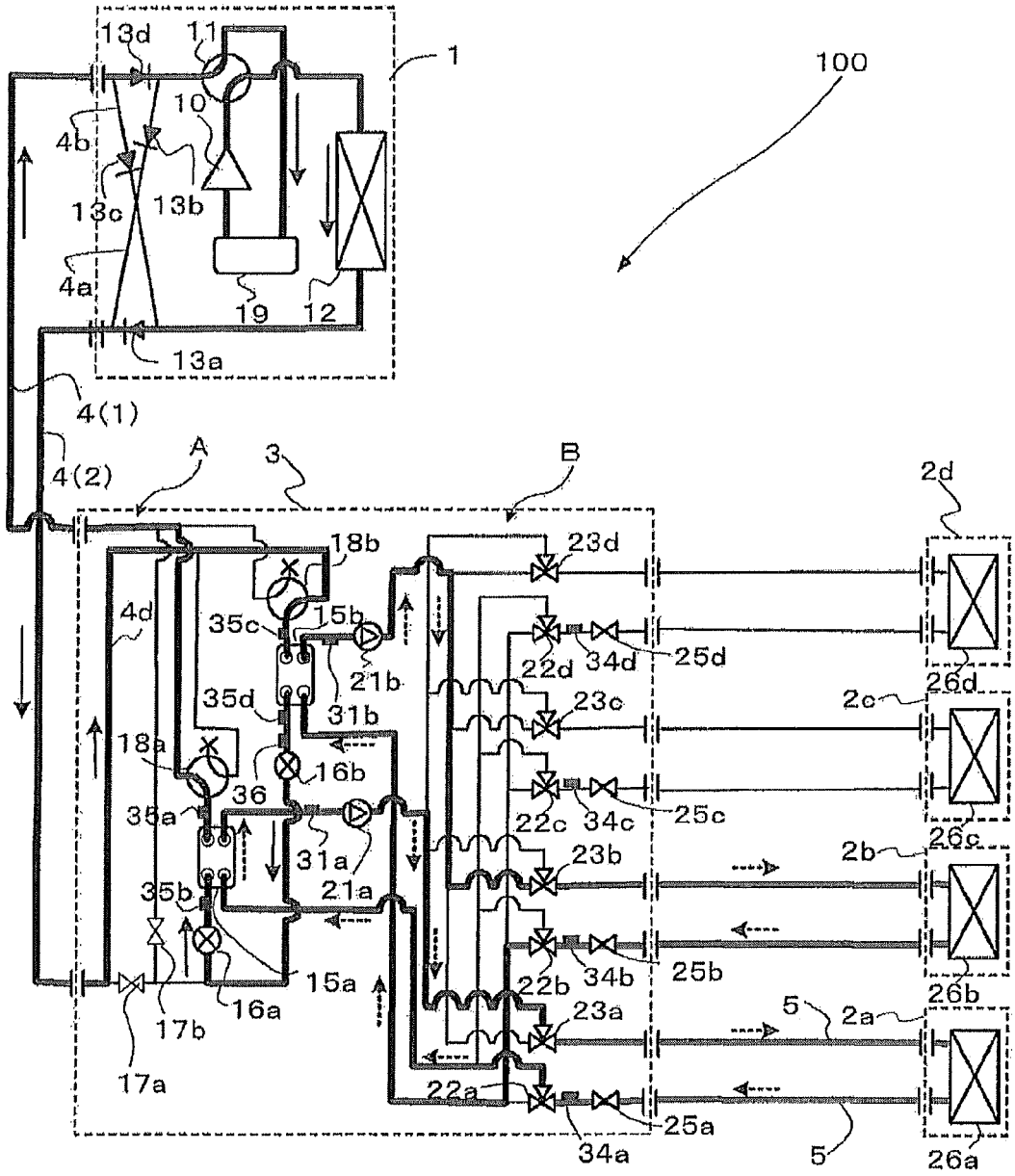
FIG. 6 is a refrigerant circuit diagram illustrating flows of refrigerants in a cooling main operation mode of the air-conditioning apparatus according to Embodiment of the invention.

FIG. 6 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 6. Furthermore, in FIG. 6, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 6.

In the cooling main operation mode illustrated in FIG. 6, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant piping 4, and flows into the heat medium relay unit 3. The two-phase refrigerant flowing into the heat medium relay unit 3 passes through the second refrigerant flow switching device 18*b* and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B to cool the heat medium, and thus turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. In addition, the opening degree of the expansion device 16*b* may be controlled such that subcooling is constant, the subcooling being obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heating the indoor space 7. In addition, in the use side heat exchanger 26*a*, the heat medium removes heat from the indoor air, thus cooling the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is again sucked into the pump 21*b*. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then again sucked into the pump 21*a*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 7:
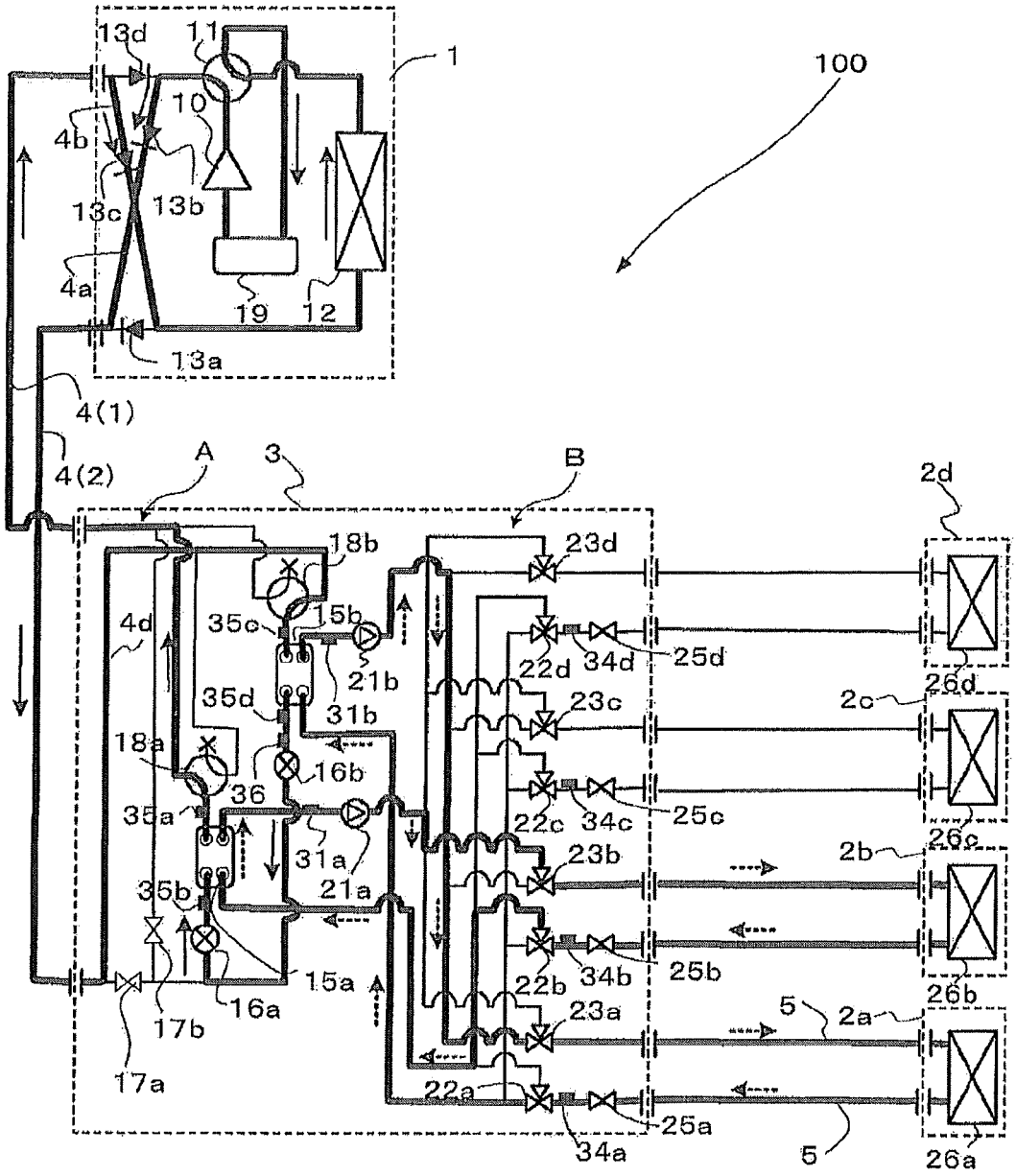
FIG. 7 is a refrigerant circuit diagram illustrating flows of refrigerants in a heating main operation mode of the air-conditioning apparatus according to Embodiment of the invention.

FIG. 7 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 7. Furthermore, in FIG. 7, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7.

In the heating main operation mode illustrated in FIG. 7, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant, which has flowed out of the outdoor unit 1, passes through the refrigerant piping 4 and flows into the heat medium relay unit 3. The high-temperature high-pressure gas refrigerant flowing into the heat medium relay unit 3 passes through the second refrigerant flow switching device 18*b* and flows into the heat exchanger related to heat medium 15*b*, functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B to evaporate, thus cooling the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant flowing into the outdoor unit 1 passes through the check valve 13*c* and flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat medium in the heat medium circuit B will be described.

In the heating main operation mode, the heat exchanger related to heat medium 16*b* transfers heating energy of the heat source side refrigerant to the heat medium, and the pump 21*b* allows the heated heat medium to flow through the pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heating the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is again sucked into the pump 21*a*. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is then again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 7, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Pipe 4]

As described above, the air-conditioning apparatus 100 according to Embodiment has several operation modes. In these operation modes, the heat source side refrigerant flows through the refrigerant pipings 4 connecting the outdoor unit 1 and the heat medium relay unit 3.

[Piping 5]

In some operation modes carried out by the air-conditioning apparatus 100 according to Embodiment, the heat medium, such as water or antifreeze, flows through the pipings 5 connecting the heat medium relay unit 3 and the indoor units 2.

[Flow Directions of Refrigerant and Heat Medium in Heat Exchanger Related to Heat Medium 15]

As aforedescribed, in any operation mode, such as the cooling only operation mode, the heating only operation mode, the cooling main operation mode, and the heating main operation mode, when the heat exchanger related to heat medium 15 is used as a condenser, the refrigerant and the heat medium is made to flow in counter directions, and when the heat exchanger related to heat medium 15 is used as a evaporator, the refrigerant and the heat medium is made to flow in the parallel direction. That is, when the heat exchanger related to heat medium 15 is used as a condenser, the refrigerant flows in the direction from the second refrigerant flow switching device 18 to the heat exchanger related to heat medium 15, and when the heat exchanger related to heat medium 15 is used as an evaporator, the refrigerant flows in the direction from the expansion device 16 to the heat exchanger related to heat medium 15. In contrast, in the heat medium circuit B, irrespective of the operation mode, the heat medium flows in the direction from the heat exchanger related to heat medium 15 to the pumps 21. This will increase the total energy efficiency of cooling and heating, and thus will enable saving of energy. Subsequently, the difference of heating or cooling efficiency according to the flow directions of the refrigerant and the heat medium in the heat exchanger related to heat medium 15 will be described.

Figure 8:
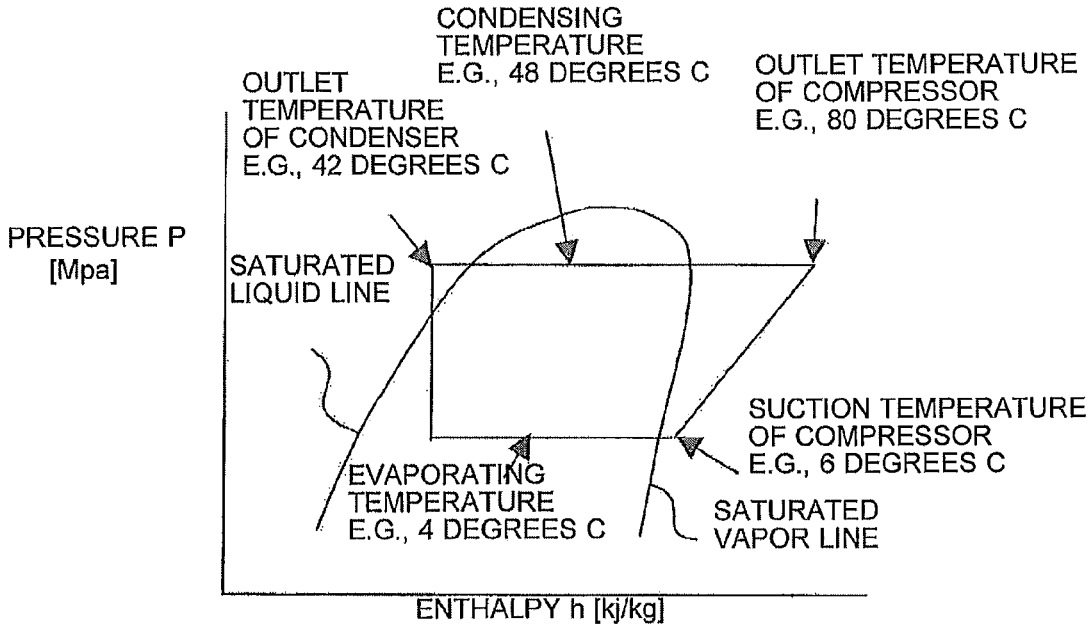
FIG. 8 is P-h diagrams illustrating operation states of an air-conditioning apparatus according to Embodiment of the invention.
Figure 8:
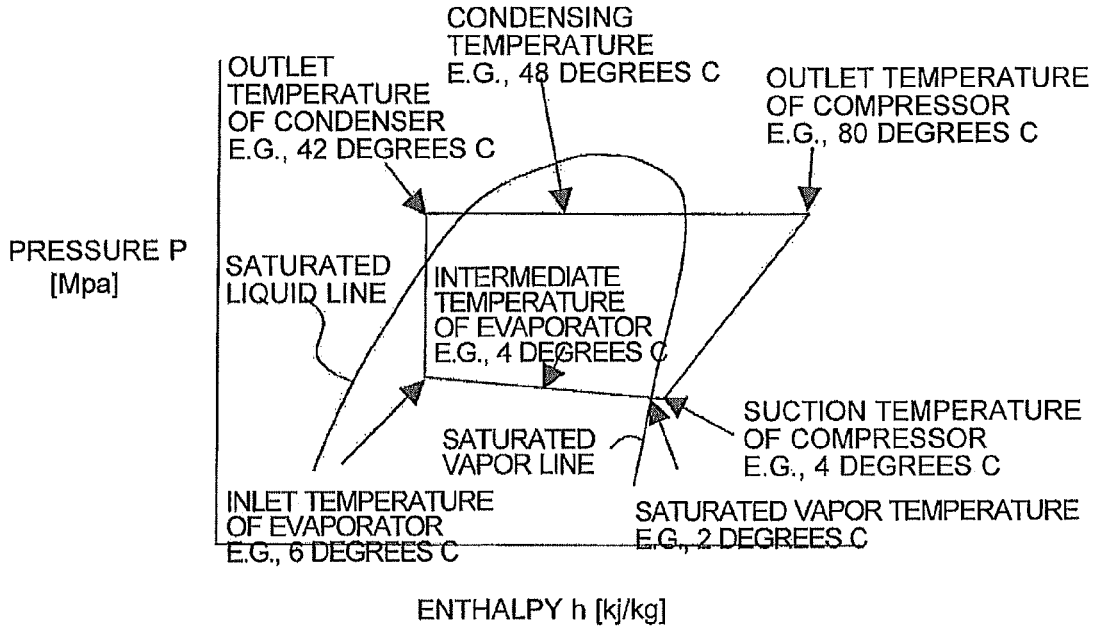

FIG. 8 is a P-h diagram illustrating an operation state of the air-conditioning apparatus according to Embodiment of the invention. In the P-h diagram (pressure-enthalpy diagram) of FIG. 8(*a*), the high-temperature high-pressure refrigerant that has flowed out of the compressor 10 flows into the condenser (heat source side heat exchanger 12 or heat exchanger related to heat medium 15) and is cooled. The refrigerant crosses over the saturated vapor line into the two-phase region, gradually increases its proportion of liquid refrigerant, turns into liquid refrigerant, is then further cooled and flows out of the condenser. The refrigerant is expanded by the expansion device 16, turns into low-temperature low pressure two phase refrigerant, and flows into the evaporator (the heat source side heat exchanger 12 or the heat exchanger related to heat medium 15) and is heated, gradually increases its proportion of gas refrigerant, crosses over the saturated liquid line, turns into gas refrigerant. After being further heated, the refrigerant flows out of the evaporator and is sucked into the compressor again. Here, the temperature of the refrigerant at the outlet of the compressor 10 is 80 degrees C., for example, the temperature (condensing temperature) of the heat source side refrigerant in the condenser in the two-phase state is 48 degrees C., for example, the temperature at the outlet of the condenser is 42 degrees C., for example, the temperature (evaporating temperature) of the heat source side refrigerant in the evaporator in the two-phase state is 4 degrees C., for example, and the suction temperature of the compressor 10 is 6 degrees C., for example.

The case in which the heat exchanger related to heat medium 15 operates as a condenser is discussed; it is assumed that the temperature of the heat medium flowing into the heat exchanger related to heat medium 15 is 40 degrees C., and the heat medium is heated by the heat exchanger related to heat medium 15 up to 50 degrees C. In this case, when the heat medium is made to flow in the counter direction (counterflow) to the flow of the refrigerant, the heat medium flowing into the heat exchanger related to heat medium 15 of 40 degrees C. is first heated by a subcooled refrigerant of 42 degrees C., slightly increases its temperature, is then further heated by a condensed refrigerant of 48 degrees C., is lastly heated by a superheated gas refrigerant of 80 degrees C., increases its temperature up to 50 degrees C., which is higher than the condensing temperature, and flows out of the heat exchanger related to heat medium 15. The subcooling temperature of the refrigerant at this time is 6 degrees C.

In contrast, when the heat medium is made to flow in the same direction (same-way flow) to the flow of the heat medium, the heat medium flowing into the heat exchanger related to heat medium 15 of 40 degrees C. is first heated by a superheated gas refrigerant of 80 degrees C., increases its temperature, and is then further heated by a condensed refrigerant of 48 degrees C. Therefore, the temperature of the heat medium flowing from the heat exchanger related to heat medium 15 does not exceed the condensing temperature. Therefore, the target temperature of 50 degrees C. is not reached, and the heating capability in the use side heat exchanger 26 is insufficient.

The refrigeration cycle with a certain degree of subcooling, for example, 5 degrees C. to 10 degrees C. increases efficiency (COP). However, because the temperature of the refrigerant does not fall below the temperature of the heat medium, even if the heat medium that has exchanged heat with the condensed refrigerant at 48 degrees C. in the heat exchanger related to heat medium 15 rises to 47 degrees C., for example, the refrigerant at the outlet of the heat exchanger related to heat medium 15 does not fall below 47 degrees C. The subcooling is, therefore, 1 degree C. or under, and the efficiency of the refrigeration cycle is reduced.

Therefore, when the heat exchanger related to heat medium 15 is used as a condenser, making the heat source side refrigerant and the heat medium flow in counter directions will increase the heating capacity along with increase in efficiency. Furthermore, the relationship between temperatures of the refrigerant and the heat medium is the same while using a refrigerant that does not change into two phase in the high-pressure side and that changes under a supercritical state, such as $CO_2$. In a gas cooler, which corresponds to a condenser for refrigerants that change into two phase, when the refrigerant is made to counter flow against the heat medium, heating capacity will increase along with the efficiency.

Next, the case in which the heat exchanger related to heat medium 15 operates as an evaporator is discussed. It is assumed that the temperature of the heat medium flowing into the heat exchanger related to heat medium 15 is 12 degrees C., and the heat medium is cooled by the heat exchanger related to heat medium 15 to 7 degrees C. In this case, when the heat medium flows in the counter direction of the flow of the refrigerant, the heat medium flowing into the heat exchanger related to heat medium 15 at 12 degrees C. is first cooled by a superheated gas refrigerant of 6 degrees C. and is then cooled by an evaporating refrigerant of 4 degrees C., becomes 7 degrees C., and flows out of the heat exchanger related to heat medium 15. In contrast, when the heat medium flows in the parallel direction to the flow of the refrigerant, the heat medium flowing into the heat exchanger related to heat medium 15 at 12 degrees C. is cooled by an evaporating refrigerant of 4 degrees C. and reduces its temperature, is then cooled by a superheated gas of 6 degrees C., becomes 7 degrees C., and flows out of the heat exchanger related to heat medium 15.

When flowing in counter directions, since there is a temperature difference of 3 degrees C. between the outlet temperature of the heat medium, which is 7 degrees C., and the outlet temperature of the refrigerant, which is 4 degrees C., the heat medium can be reliably cooled. In contrast, when flowing in parallel, since there is only a temperature difference of 1 degree C. between the outlet temperature of the heat medium, which is 7 degrees C., and the outlet temperature of the refrigerant, which is 6 degrees C., depending on the flow velocity of the heat medium, the outlet temperature of the heat medium may not be cooled to 7 degrees C.; a certain drop of cooling capacity can be projected. However, as regard the evaporator, the efficiency is better when there is substantially no superheat, and the superheat is controlled to approximately 0 to 2 degrees C. Accordingly, the difference of the cooling capacities are not so large between when flowing in counter directions and when flowing in the parallel direction.

The pressure of the refrigerant in the evaporator is lower than that in the condenser, so the density is smaller and the pressure loss is more likely to occur. A P-h diagram when there is pressure loss in the evaporator will be shown in FIG. 8(*b*). Assuming that the temperature of the refrigerant at midpoint of the evaporator is 4 degrees C., which is the same temperature as when there is no pressure loss, then, the temperature of the refrigerant at the inlet of the evaporator will be 6 degrees C., for example, the temperature of the refrigerant that becomes saturated gas in the evaporator will be 2 degrees C., for example, and the suction temperature of the compressor will be 4 degrees C., for example. In this state, when the heat medium flows in the counterflow direction of the flow of the refrigerant, the heat medium flowing into the heat exchanger related to heat medium 15 at 12 degrees C. is first cooled by a superheated gas refrigerant of 4 degrees C., is then cooled by an evaporating refrigerant that changes its temperature from 2 degrees C. to 6 degrees C. by pressure loss, is lastly cooled by the refrigerant of 6 degrees C., becomes 7 degrees C., and flows out of the heat exchanger related to heat medium 15. In contrast, when the heat medium flows in the parallel direction to the flow of the refrigerant, the heat medium flowing into the heat exchanger related to heat medium 15 at 12 degrees C. is cooled by an evaporating refrigerant of 6 degrees C., reduces its temperature, then further reduces its temperature in line with the refrigerant reducing its temperature from 6 degrees C. to 2 degrees C. by pressure loss. Ultimately, the refrigerant of 6 degrees C. and the heat medium of 7 degrees C. flow out of the heat exchanger related to heat medium 15.

In this state, the cooling efficiency is substantially the same when in counter flow directions and when in the parallel flow direction. In addition, if the pressure loss of the refrigerant in the evaporator further increases, the cooling efficiency may be improved if made to flow in parallel. Therefore, when the heat exchanger related to heat medium 15 is used as an evaporator, the refrigerant and the heat medium may flow in counter directions or in the parallel direction.

From the above, taking into consideration that the heat medium circulating in the heat medium circuit B flows in a constant direction and when the heat exchanger related to heat medium 15 is used as a condenser, the flow is made to counterflow, then, by making the flow to flow in the parallel direction when the heat exchanger related to heat medium 15 is used as an evaporator, the total efficiency of heating and cooling can be increased.

[Oil Collecting Mode]

Figure 9:
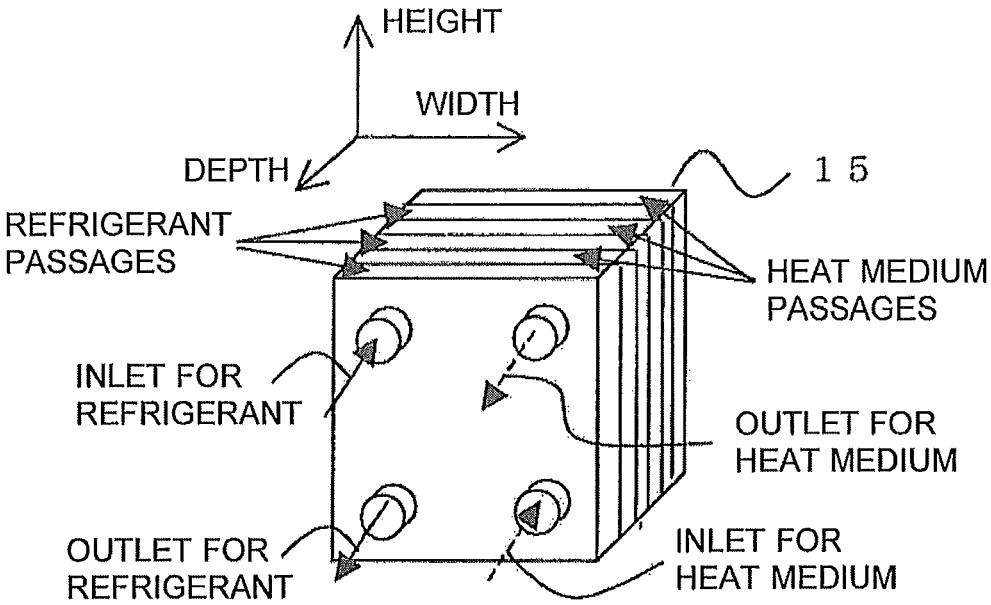
FIG. 9 is a diagram illustrating a structure of a plate heat exchanger of an air-conditioning apparatus according to Embodiment of the invention.
Figure 9:
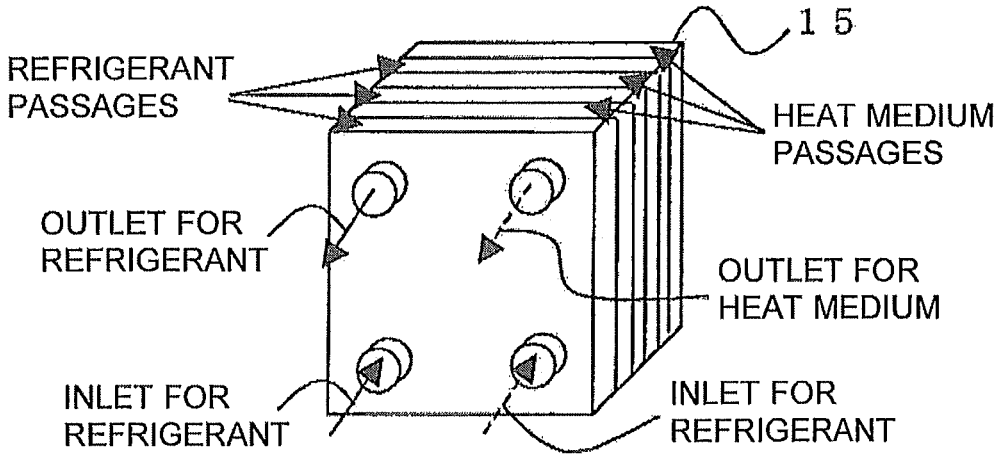

FIG. 9 is a diagram illustrating a structure of a plate heat exchanger of an air-conditioning apparatus according to Embodiment of the invention. In FIG. 9, a plate heat exchanger is shown as an example of the heat exchanger related to heat medium 15. A plate heat exchanger is a superposed layer of multiple metal plates (boards), and a refrigerant passage (refrigerant side passage) in which a heat source side refrigerant (refrigerant) flows therethrough and a heat medium passage in which a heat medium flows therethrough are formed alternately between the plates. Further, the plate heat exchanger is configured such that the refrigerant and the heat medium flow between the plates alternately, and the refrigerant and the heat medium exchange heat through each plate. Note that in FIGS. 9(*a*) and (*b*), the refrigerant passage is arranged so as to be substantially vertical, and the upper side of the paper is the upper part and the bottom side is the lower part.

When the heat exchanger related to heat medium 15 is used as a condenser, as aforementioned, the refrigerant and the heat medium needs to flow in counter directions. When the heat exchanger related to heat medium 15 is a plate heat exchanger, while functioning as a condenser, the piping should be such that the refrigerant flows through the refrigerant passage from the upper part to the lower part and the heat medium flows from the lower part to the upper part, as shown in FIG. 9(*a*). While the heat exchanger related to heat medium 15 is operating as a condenser, a high-temperature high-pressure gas refrigerant flows into the heat exchanger related to heat medium 15 and is condensed into a two-phase refrigerant, gradually increasing its rate of liquid refrigerant, and ultimately flows out of the heat exchanger related to heat medium 15 as a liquid refrigerant. Since the liquid refrigerant has a larger density (heavier) than that of the gas refrigerant, when the flow is formed in a vertical direction in the condenser and when the refrigerant is made to flow into the heat exchanger related to heat medium 15 from the upper part and flow out from the lower part thereof, then gravitational potential energy of the falling liquid refrigerant can be used, and accordingly, conveyance power can be reduced and operating efficiency can be improved. Hence, while operating as a condenser, the refrigerant is made to flow into the upper part of the heat exchanger related to heat medium 15 and flow out from the lower part thereof. Note that when a refrigerant that turns into a supercritical state, such as $CO_2$ is used, the refrigerant does not change into a two-phase refrigerant on the high-pressure side, and the heat exchanger related to heat medium 15 becomes a gas cooler. Even in this case, the density of the refrigerant becomes larger (heavier) when the refrigerant is cooled, and thus, the same is true. It should be noted that in the subsequent description, the heat exchanger related to heat medium 15 that operates as a condenser includes the heat exchanger related to heat medium 15 that operates as a gas cooler.

On the other hand, when the heat exchanger related to heat medium 15 functions as an evaporator, the piping is to be such that the refrigerant flows through the refrigerant passage from the lower part to the upper part and the heat medium flows from the lower part to the upper part, as shown in FIG. 9(*b*). While the heat exchanger related to heat medium 15 is operating as an evaporator, a low-temperature low-pressure two phase refrigerant flows into the heat exchanger related to heat medium 15 and is evaporated, gradually increasing its rate of gas refrigerant, and ultimately flows out of the heat exchanger related to heat medium 15 as a gas refrigerant. Since the liquid refrigerant has a larger density (heavier) than that of the gas refrigerant, when the flow is formed in a vertical direction in the evaporator and when the refrigerant is made to flow into the heat exchanger related to heat medium 15 from the lower part and flow out from the upper part thereof, then buoyancy of the ascending gas refrigerant can be used, and accordingly, conveyance power can be reduced and operating efficiency can be improved. Since the plate heat exchanger operating as an evaporator needs to have refrigerant in a two-phase state distributed between each plate, if the refrigerant is made to flow from the upper part of the plate heat exchanger, the distribution of the refrigerant will not be uniform due to the influence of gravity (the plate near the inlet will have more liquid refrigerant flowing therein), and, thus, heat exchange rate will be hindered. Hence, while operating as an evaporator, the refrigerant is made to flow into the lower part of the heat exchanger related to heat medium 15 and flow out from the upper part thereof.

In addition, in a plate heat exchanger, structurally, it is most efficient when the refrigerant is made to flow in the vertical direction (perpendicular). When the plate heat exchanger is used at an angle that is larger than the horizontal angle, for example, inclined slightly from the vertical state, the capacity of the heat exchange will drop. However, the plate heat exchanger can be used with a slight inclination when the height needs to be lowered. In addition, in this case, the flow directions of the refrigerant and the heat medium are the same, and when operating as a condenser, the refrigerant may be made to flow from the upper part to the lower part, and when operating as an evaporator, the refrigerant may be made to flow from the lower part to the upper part.

In the refrigerant pipings 4 of the refrigeration cycle (refrigerant circuit), refrigerating machine oil that lubricate and seal the compressor 10 with the refrigerant flows therethrough. As regards the refrigerating machine oil, poly-alkylbenzenes, polyol esters, or the like is used. In the refrigerant pipings 4 and the heat exchangers related to heat medium 5, when an ascending current of refrigerant flowing from the lower part to the upper part is formed, if the flow velocity of the refrigerant is equal to or higher than a certain velocity (zero penetration velocity), then the refrigerating machine oil deposited on the inner wall of the refrigerant pipings 4 or the heat exchangers related to heat medium 15 ascends, denying its own weight. However, if the flow velocity of the refrigerant is equal to or lower than a certain velocity (zero penetration velocity), then the refrigerating machine oil cannot ascend and deny its own weight, and the oil stagnates in the refrigerant pipings 4 or the heat exchangers related to heat medium 15. Using the inside diameter of the refrigerant pipings 4 or the equivalent diameter of the refrigerant passage in the heat exchangers related to heat medium 15, and the status value of the vapor-liquid refrigerant, this zero penetration velocity Ug* can be calculated by the empirical formula of Wallis expressed as the following equation (1).

[Math 1]

$$U_g^* = c \times \sqrt{g \times d \times \frac{\rho_{oil} - \rho_g}{\rho_g}} \tag{1}$$

(c: coefficient, g: gravitational acceleration 9.8) [m/s$^2$], d: inside diameter of the refrigerant piping or the equivalent diameter of the refrigerant passage in the heat exchanger related to heat medium [m], $\rho_g$ density of the gas refrigerant [kg/m$^3$], $\rho_{oil}$: density of the refrigerating machine oil [kg/m])

On the other hand, the refrigerant velocity Ug in the plate heat exchanger can be obtained by the following equation (2).

[Math 2]

$$U_g = \frac{G_r}{\rho_g \times A_p} \tag{2}$$

($G_r$: mass flow rate of the refrigerant, $\rho_g$: gas density of the refrigerant [kg/m$^3$], $A_p$: total value of the cross-sectional area of the passage of the refrigerant in the plate heat exchanger [m$^2$])

Subsequently, two examples illustrating the zero penetration velocity and the refrigerant flow velocity in the plate heat exchanger will be shown. Note that the coefficient c in equation (1) is 1.0. First, as a first example, a case in which the inside dimensions of the plate heat exchanger are 90 mm in width, 58.75 mm in depth, and 231 mm in height, the plate interval (inside dimension) is 1.85 mm, and the number of plates is 25, will be discussed. Note that the cross-sectional area $A_1$ of a passage of the refrigerant is as follows.

$$A_1=1.85\times90=166.5[\mathrm{mm}^2] \quad \text{[Math 3]}$$

Further, an equivalent diameter d of a passage in the plate heat exchanger is obtained with the following equation, $$d=4\times A_1/(90\times2+1.85\times2)=3.63[\mathrm{mm}] \quad \text{[Math 4]}$$

Assuming that R410A is used as the refrigerant, for example, and the evaporating temperature of the refrigerant is 4 degrees C., then the saturated gas density of the refrigerant will be 34.6 kg/m$^3$. Assuming that as for each of the heat exchangers related to heat medium 15*a* and 15*b*, two plate heat exchangers are used amounting to four plate heat exchangers, the heat exchangers related to heat medium are each connected in parallel while in use (cooling only operation), capacity of about 28 kW is outputted, the dryness of the refrigerant at the inlet of the evaporator is 0.2, and the refrigerant at the exit is in a saturated gas state, then the quantity of heat of evaporation in the evaporator will be 0.8 times of 216 kJ/kg, 216 kJ/kg being the quantity of latent heat of R410A at 4 degrees C., and the mass flow rate $G_r$ of the refrigerant flowing in a single plate heat exchanger will be 0.0405 kg/s (145.8 kg/h), obtained by the following equation.

[Math 5]

$$G_r=\frac{28/4}{216\times0.8}=0.0405\ [\mathrm{kg/s}]$$

With the above and using equation (2), the flow velocity of the refrigerant is 0.56 m/s as obtained in the following equation.

$$U_g=0.04045/[34.6\times(A_1\times10^{-6}\times25/2)]=0.56\ [\mathrm{m/s}] \quad \text{[Math 6]}$$

On the other hand, assuming that the density of the refrigerating machine oil is 960 kg/m$^3$, then the zero penetration velocity will be 0.98 m/s as obtained in the following equation.

[Math 7]

$$U_g^*=1.0\times\sqrt{9.8\times(3.63\times10^{-3})\times\frac{960-34.6}{34.6}}=0.98[\mathrm{m/s}]$$

Consequently, the flow velocity of the refrigerant is lower than the zero penetration velocity. Thus, the refrigerating machine oil will stagnate in the plate heat exchanger, and will not return to the compressor 10. When this condition continues for a long time, the refrigerating machine oil that is required in the compressor 10 is not secured and there is a risk of burn-out of the compressor due to the lack of oil. In such a case, an operation collecting oil to the condenser 10 by discharging the refrigerating machine oil in the plate heat exchanger is required.

[Collecting Oil by Increasing Flow Velocity of Refrigerant]

In such a case, collecting oil by increasing the flow velocity of the refrigerant in the plate heat exchanger is considered. In order to achieve this, the flow velocity of the refrigerant is to be 1.75 times or more (=0.9810.56).

In the cooling main operation mode illustrated in FIG. 6 or in the heating main operation mode illustrated in FIG. 7, the refrigerant flows to the heat exchangers related to heat medium 15*b* and 15*a* in series. When compared to the cooling only operation mode illustrated in FIG. 4 or the heating only operation mode illustrated in FIG. 5, in which the refrigerant flows to the heat exchangers related to heat medium 15*b* and 15*a* in parallel, the flow velocity of the refrigerant is approximately 2 times as fast. Accordingly, in the cooling main operation mode and the heating main operation mode, the flow velocity of the refrigerant exceeds the zero penetration velocity, and, as a result, no refrigerating machine oil will stagnate in the heat exchangers related to heat medium 15. However, the flow velocity of the refrigerant is dependent on the heat load, and, thus, an oil collection mode described below will be carried out.

Specifically, in the above-mentioned heating main operation mode or the cooling main operation mode, the elapsed time of the operation is integrated, and when the integration time reaches a prescribed value (90 min, for example) the opening degree of the expansion device 16*b* is set to a larger degree than that of the steady state (a state before the execution of the oil collection mode) (for example, 1.3 times wider than the opening degree of the steady state). The operation is carried out for a fixed period of time under this condition. The flow velocity of the refrigerant in the heat exchangers related to heat medium 15 is increased, and the stagnating refrigerating machine oil is discharged from the heat exchangers related to heat medium 15 and is returned (collected) to the compressor 10. Note that after the oil collection mode has been executed, the integration time is set to nil, and the above operation is executed each time the integration time reaches the prescribed value.

In the cooling only operation mode illustrated in FIG. 4 or in the heating only operation mode illustrated in FIG. 5, the oil collection mode will be executes as below. In the cooling only operation mode or the heating only operation mode described above, the elapsed time of the operation is integrated, and when the integration time reaches a prescribed value, the opening degree of the expansion device 15*a* or 15*b* corresponding to either one of the heat exchanger related to heat medium 16*a* or 16*b* is set to a smaller degree than that of the steady state (a state before the execution of the oil collection mode), and the opening degree of the expansion device 15*a* or 15*b* corresponding to the other one of the heat exchanger related to heat medium 16*a* or 16*b* is set to a larger degree than that of the steady state. The operation is carried out for a fixed period of time under this condition. The flow velocity of the refrigerant in the heat exchanger related to heat medium 15*a* or 15*b* corresponding to the expansion device 16 that has been set to a large opening degree is increased, and the stagnating refrigerating machine oil in the above heat exchanger related to heat medium 15 is collected to the compressor 10. Note that after the oil collection mode has been executed, the integration time is set to nil, and the above operation is executed each time the integration time reaches the prescribed value.

For example, the opening degree of the expansion device 16*a* corresponding to the heat exchanger related to heat medium 15*a* is totally closed, and the opening degree of the expansion device 16*b* corresponding to the heat exchanger related to heat medium 15*b* is set larger than that of the steady state (1.8 times, for example). In this case, entirety of the refrigerant flows into the heat exchanger related to heat medium 15*b* and the flow velocity of the refrigerant in the heat exchanger related to heat medium 15*b* becomes 2 times or more. Accordingly, the refrigerating machine oil is discharged from the heat exchanger related to heat medium 15 and can be returned to the compressor 10. In this case, after the refrigerating machine oil in the heat exchanger related to heat medium 15*b* is discharged, the expansion devices 16*a* and 16*b* are controlled such that the refrigerant mainly flows into the heat exchanger related to heat medium 15*a*. Accordingly, the flow velocity of the refrigerant in the heat exchanger related to heat medium 15*a* is increased and the refrigerating machine oil in the heat exchanger related to heat medium 15*a* is discharged. As above, by discharging the refrigerating machine oil in each of the heat exchangers related to heat medium 15 in turn, the stagnating refrigerating machine oil in all of the plurality of heat exchangers related to heat medium 15 can be returned (collected) to the compressor 10.

Furthermore, in the cooling only operation mode or in the heating only operation mode, the subsequent oil collection mode may be executed. In the above-mentioned cooling only operation mode, the elapsed time of the operation is integrated, and when the integration time reaches a prescribed value, the second refrigerant flow switching device 18*b* is switched such that the refrigerant passage is switched to the same passage as the passage of the refrigerant of the cooling main operation mode. The opening degree of the expansion device 16*b* is set to be larger than the opening degree of the steady state and the operation is carried out for a fixed period of time. This will increase the flow velocity of the refrigerant flowing in the heat exchangers related to heat medium 15*a* and 15*b*, and it will be possible to collect the stagnating refrigerating machine oil to the compressor 10. In the above-mentioned heating only operation mode, the elapsed time of the operation is integrated, and when the integration time reaches a prescribed value, the second refrigerant flow switching device 18*a* is switched such that the refrigerant passage is switched to the same passage as the passage of the refrigerant of the heating main operation mode. The opening degree of the expansion device 16*b* is set to be larger than the opening degree of the steady state and the operation is carried out for a fixed period of time. This will increase the flow velocity of the refrigerant flowing in the heat exchangers related to heat medium 15*a* and 15*b*, and it will be possible to collect the stagnating refrigerating machine oil to the compressor 10.

By implementing the above oil collection mode, even when the heat exchanger related to heat medium 15 is a plate heat exchanger in which the refrigerant flows in a vertical direction, and even when the heat exchanger related to heat medium 15 is a double-pipe heat exchanger or a microchannel heat exchanger in which the refrigerant flows in the horizontal direction, the refrigerating machine oil in the heat exchanger related to heat medium 15 can be returned to the compressor 10.

[Collecting Oil by Switching Flow Direction of Refrigerant]

Next, as a second example, a case in which the inside dimensions of the plate heat exchanger, which is a heat exchanger related to heat medium 15, are 90 mm in width, 117.5 mm in depth, and 231 mm in height, the plate interval (inside dimension) is 1.85 mm, and the number of plates is 50, will be discussed. In this case, the number of plates is twice the number compared to the aforementioned first example, and others are the same. Hence, the flow velocity of the refrigerant is half of the first example and is 0.28 m/s.

In such a case, in order to collect oil by increasing the flow velocity of the refrigerant in the plate heat exchanger, the flow velocity of the refrigerant need to be 3.5 times or more (=0.98/0.28), and it is difficult to collect the oil with the operation aforedescribed in the first example. Hence, oil collection with a different method is required. It should be noted that the description will be made for a case in which the heat exchanger related to heat medium 15 is a plate heat exchanger, but not limited to this, even with a heat exchanger with a different configuration, as long as the refrigerant passage is formed from the lower part to the upper part when used as a evaporator, the same is true. However, the below method is not feasible to heat exchangers in which the refrigerant passage is formed in the horizontal direction.

As regards the plate heat exchanger, when it is functioning as an evaporator, the refrigerant flows from the lower part to the upper part, and when it is functioning as a condenser, flows from the upper part to the lower part. When the refrigerant is flowing from the upper part to the lower part, due to the effect of gravity, irrespective of the flow velocity of the refrigerant, it is difficult for the refrigerating machine oil to stagnate in the plate heat exchanger, and the oil is discharged outside thereof. Hence, when a plate heat exchanger functioning as a evaporator is switched to function as a condenser, the refrigerating machine oil in the plate heat exchanger will be discharged outside thereof. If the inside of the connecting pipings at the inlet and the outlet of the plate heat exchanger are designed so that the flow velocity of the refrigerant inside is the same or greater than the zero penetration velocity, and if the refrigerating machine oil is discharged out of the plate heat exchanger, then the refrigerating machine oil will be returned to the compressor 10. Further, the time for the refrigerant to travel from the upper end to the lower end is determined by dividing the height of the plate heat exchanger 231 mm with the flow velocity of the refrigerant 0.28 m/s, and is 0.8 sec. Even if the traveling speed of the refrigerating machine oil is a fraction slower than the flow velocity of the refrigerant, when the refrigerant is made to pass from the upper part to the lower part, then the refrigerating machine oil will be discharged from the plate heat exchanger in a moment of seconds. Subsequently, a first oil collection operation mode and a second oil collection operation mode that collects oil by changing the flow direction of the above refrigerant will be described.

[First Oil Collection Operation Mode]

An operation in the heating main operation mode will be described. In this case, since only one out of the plate heat exchangers (heat exchanger related to heat medium 15*a*) is functioning as an evaporator, the plate heat exchanger functioning as the evaporator will be made to function as a condenser. Here, the first oil collection operation mode is carried out in which the plate heat exchanger functioning as an evaporator (heat exchanger related to heat medium 15*a*) is made to function as a condenser by sending a high-temperature high-pressure refrigerant discharged from the compressor 10 thereto. Specifically, the heat exchanger related to heat medium 15*a* is made to function as a condenser by switching the second refrigerant flow switching device 18*a* so that the refrigerant passage is the same as that of the heating only operation mode illustrated in FIG. 5. In this first oil collection operation mode, all of the heat exchangers related to heat medium 15*a* and 15*b* function as a condenser, and, thus, the refrigerating machine oil in the heat exchanger related to heat medium 15*a* that had been functioning as an evaporator during the heating main operation mode is discharged out of the heat medium relay unit 3 through the on-off device 17*b* and is returned to the compressor 10.

In this case, similar to the heating only operation mode, the opening degree of the expansion device 16*a* may be controlled such that subcooling (degree of subcooling) obtained as the difference between a saturation temperature converted from a pressure detected by the pressure sensor 36 and a temperature detected by the third temperature sensor 35*b* is constant. Further, as described above, the operation time of the first oil collection operation mode only requires a moment of seconds (10 sec, for example), the opening degree during the first oil collection operation mode may be fixed. For example, the opening degree of the expansion device 16*b* connected to the heat exchanger related to heat medium 15*b* that had been functioning as a condenser during the heating main operation mode is stored, and the opening degree of the expansion device 16*a* is set so as to be substantially the same as the opening degree of the expansion device 16*b*. By carrying out the above, there will be no hunting in the expansion device 16, and a stable oil collection operation can be carried out. It should be noted that with this method, the temperature of the heat medium exchanging heat in the heat exchanger related to heat medium 15*a* is low (7 degrees C., for example), and the amount of heat exchange increases suddenly, and, thus, the refrigerant pressure on the high-pressure side drops. Because of this, the saturation temperature of the refrigerant in the heat exchanger related to heat medium 15*b* that had been functioning as a condenser during the heating main operation mode drops. When the saturation temperature of this refrigerant is higher than the temperature of the heat medium (45 degrees C., for example), the refrigerant will condense and the function will be as per normal. However, when the temperature is lower than the temperature of the heat medium, the refrigerant temperature (80 degrees C., for example) at the inlet of the heat exchanger related to heat medium 15*b* will only be cooled to the temperature of the heat medium (45 degrees C., for example) and will not reach its saturation temperature. Hence, the refrigerant may flow out of the heat exchanger related to heat medium 15*b* as a gas refrigerant without any change of state. As above, depending on the saturation temperature of the refrigerant, the state of the refrigerant passing through the heat exchanger related to heat medium 15*b* changes. Accordingly, in some cases, there may be a hunching of the refrigerant, allowing no stability. However, no problem will occur if the opening degree of the expansion device 16 is fixed.

Furthermore, during the first oil collection operation mode, the refrigerant passage is as shown in FIG. 5 and the refrigerant is made to flow to each heat exchangers related to heat medium 15*a* and 15*b* separately. Accordingly, the flow rate of the refrigerant in each heat exchanger related to heat medium 15 is lower compared to the flow rate of the refrigerant in the heat exchangers related to heat medium 15*a* and 15*b* during heating main operation mode. Therefore, although during the first oil collection operation mode, a case has been described in which the opening degree of the expansion device 16*a* is set to the same opening degree as that of the expansion device 16*b*. However, the opening degrees of the expansion devices 16*a* and 16*b* can be set to be a little smaller in relation to the opening degree of the expansion device 16*b* during heating main operation (for example, an opening degree of 80 percent of the opening degree of the expansion device 16*b* during heating main operation). The refrigeration cycle accordingly will be stable. However, because the operating time of the first oil collection operation mode is short, there will be no problem with either of the opening degrees. Alternatively, because the operating time is short, even when the opening degrees of the expansion devices 16*a* and 16*b* are set at opening degrees that has been stored in the system in advance, no problem will occur. It should be noted that in the subsequent description of the second oil collection operation mode, other than when a description on the setting method of the expansion device 16 is stated, the setting method will be the same as that of the first oil collection operation mode.

Figure 10:
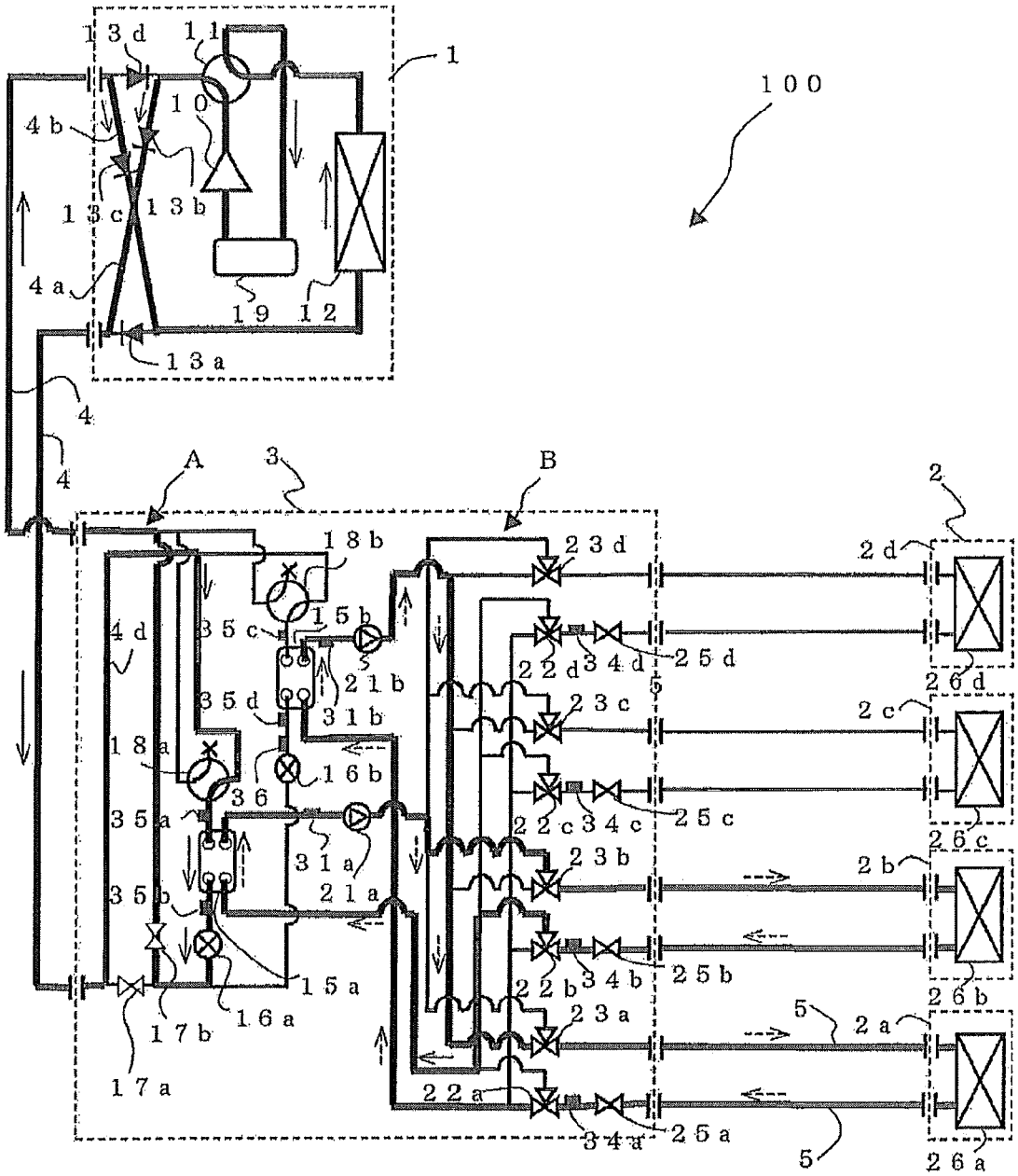
FIG. 10 is a refrigerant circuit diagram illustrating flows of refrigerants in a first oil collection operation mode of the air-conditioning apparatus according to Embodiment of the invention.

Additionally, since only the heat exchanger related to heat medium 15*a* functions as an evaporator during the heating main operation mode, the heat exchanger related to heat medium 15*a* may be switched as a condenser, and another first oil collection operation mode may be carried out in which no refrigerant or a reduced rate of flow is made to flow in the heat exchanger related to heat medium 15*b*. For example, as shown in FIG. 10, the second refrigerant flow switching device 18*a* may be switched such that the heat exchanger related to heat medium 15*a* functions as a condenser, and the opening degree of the expansion device 16*b* set to be totally closed or reduced to a sufficiently low opening degree so as to stop or reduce the flow rate of the refrigerant flowing in the heat exchanger related to heat medium 15*b*. In this case, the opening degree of the expansion device 16*b* connected to the heat exchanger related to heat medium 15*b* that had been functioning as a condenser during the heating main operation mode may be stored, the opening degree of the expansion device 16*a* may be set so as to be substantially the same as the opening degree of the expansion device 16*b*, and the opening degree may be fixed while in the first oil collection operation mode. By carrying out the above, there will be no hunting in the expansion device 16, and a stable oil collection operation can be carried out.

[Second Oil Collection Operation Mode]

Next, an operation in the cooling main operation mode will be described. In this case, since only one out of the plate heat exchangers (heat exchanger related to heat medium 15*a*) is functioning as an evaporator, the plate heat exchanger functioning as the evaporator will be made to function as a condenser. The easiest way is to switch the first refrigerant flow switching device 11 to allow the heat source side heat exchanger 12 to function as an evaporator, and make the refrigerant flow in the same manner as in the heating only operation mode. As above-mentioned, the operation of collecting the refrigerating machine oil by switching the plate heat exchanger from an evaporator to a condenser is only required to be carried out for a moment of seconds. In order to avoid the cooling capacity or heating capacity from dropping after resuming to the previous operation mode from the operation for collecting oil, it is preferable that the first refrigerant flow switching device is not switched. In the cooling main operation mode, in order to establish a refrigeration cycle while having the heat source side heat exchanger 12 operate as a condenser, one of the heat exchanger related to heat medium 15 needs to operate as an evaporator. In this case, however, the refrigerating machine oil stagnates in the heat exchanger related to heat medium 15 that is functioning as the evaporator, and the refrigerating machine oil cannot be collected.

Figure 11:
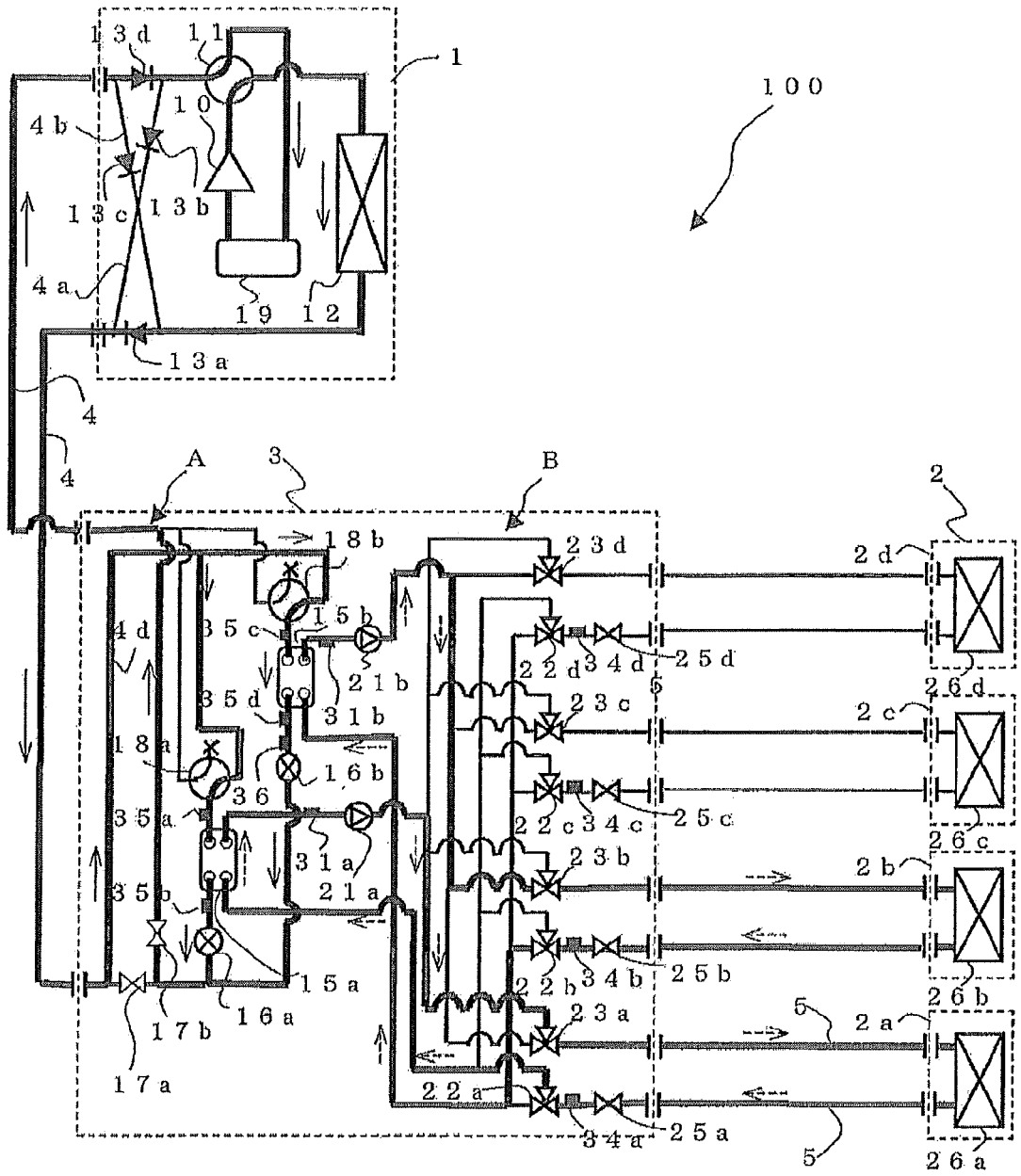
FIG. 11 is a refrigerant circuit diagram illustrating flows of refrigerants in a second oil collection operation mode of the air-conditioning apparatus according to Embodiment of the invention.

Here, the second oil collection operation mode is carried out in which the plate heat exchanger operating as an evaporator (heat exchanger related to heat medium 15*a*) is made to operate as a condenser by sending a high-temperature high-pressure refrigerant while the heat source side heat exchanger 12 is operating as a condenser. Specifically, as shown in FIG. 11, while the switching state of the first refrigerant flow switching device 11 is maintained as it is, the switching state of the second refrigerant flow switching device 18*a* is controlled such that the heat exchanger related to heat medium 15*a* that has been operating as an evaporator is made to operate as a condenser by sending a high-temperature high-pressure refrigerant therein. In this second oil collection operation mode, all of the heat exchangers related to heat medium 15*a* and 15*b* function as a condenser, and, thus, the refrigerating machine oil in the heat exchanger related to heat medium 15*a* that had been functioning as an evaporator during the cooling main operation mode is discharged out of the heat medium relay unit 3 through the on-off device 17*b* and is returned to the compressor 10. In this second oil collection operation mode, since there is no heat exchanger operating as an evaporator, the compressor 10 is in a liquid-back-flowing operation in which the liquid refrigerant back flows thereto. However, the operation time of the second oil collection operation mode is only required to be carried out for a moment of seconds (10 sec, for example), so the liquid refrigerant is stored in the accumulator 19. Accordingly, the amount of liquid refrigerant flowing back to the compressor 10 does not greatly increase, and no problem will occur.

Additionally, during the second oil collection operation mode, the opening degree of the expansion device 16*a* may be fixed. For example, the opening degree of the expansion device 16*b* connected to the heat exchanger related to heat medium 15*b* that had been functioning as a condenser during the cooling main operation mode is stored, and the opening degree of the expansion device 16*a* is set so as to be substantially the same as the opening degree of the expansion device 16*b* and the opening degree of the expansion device 16*a* is set so as to be substantially the same as the opening degree of the expansion device 16*b*. By carrying out the above, there will be no hunting in the expansion device 16, and a stable oil collection operation can be carried out. Furthermore, with this method, the temperature of the heat medium exchanging heat in the heat exchanger related to heat medium 15*a* is low (7 degrees C., for example), and the amount of heat exchange increases suddenly, and, thus, the refrigerant pressure on the high-pressure side drops. Accordingly, the saturation temperature of the refrigerant in the heat exchanger related to heat medium 15*b* that had been operating as a condenser during the cooling main operation drops and there will be a possibility of a refrigerant with a saturation temperate lower than the temperature of the heat medium (45 degrees C., for example) that is to exchanges heat therewith to flow into the heat exchanger related to heat medium 15*b*. In this case, although the flow of the refrigerant in the heat exchanger related to heat medium 15*b* is that of a condenser, the heat exchanger related to heat medium actually functions as an evaporator, cooling the heat medium. However, the temperature difference between the saturation temperature of this refrigerant and the temperature of the heat medium is not large and, moreover, the operation time of the second oil collection operation mode is short, so there will be no particular problem.

Figure 12:
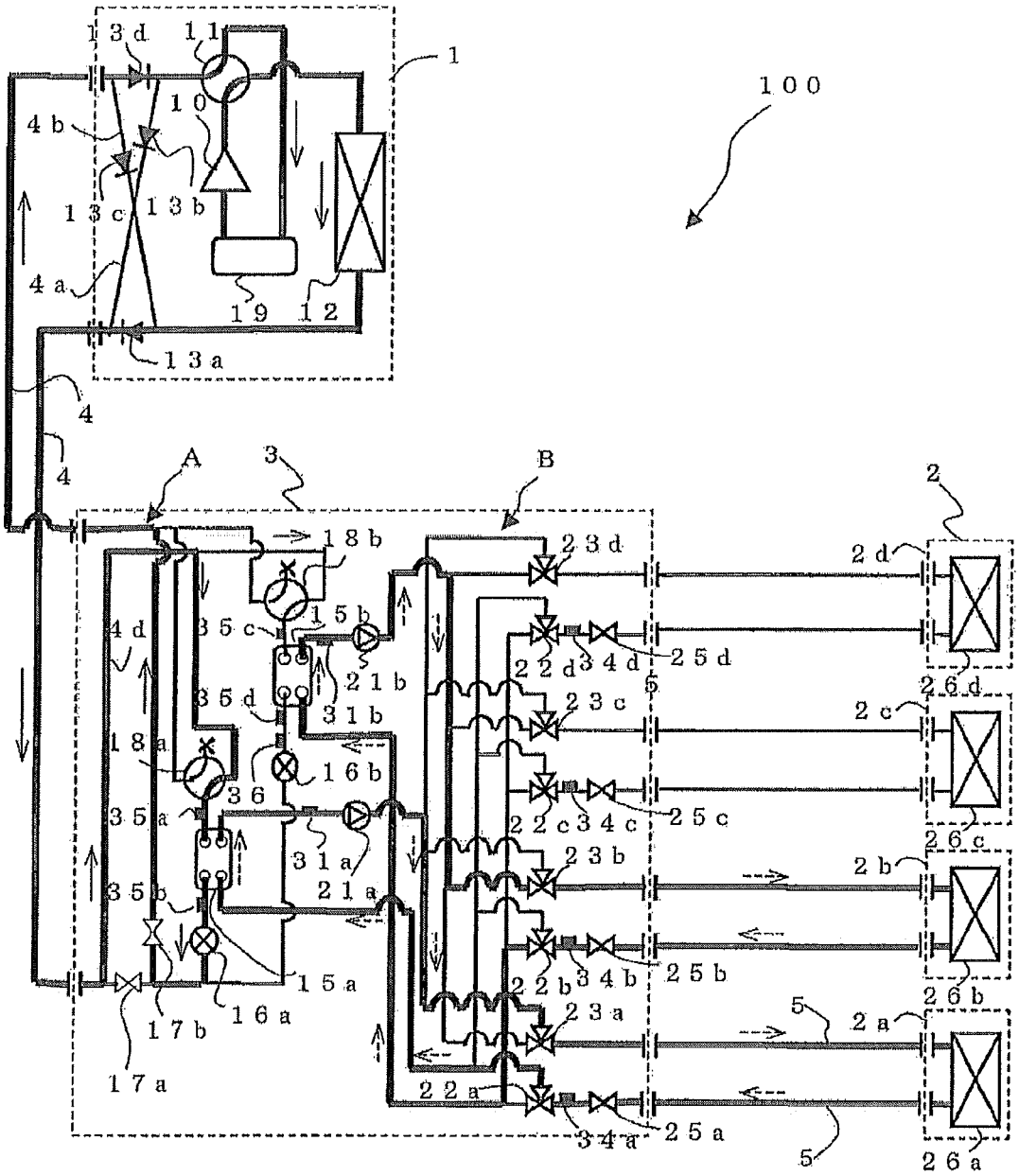
FIG. 12 is a refrigerant circuit diagram illustrating flows of refrigerants in a second oil collection operation mode of the air-conditioning apparatus according to Embodiment of the invention.

Additionally, since only the heat exchanger related to heat medium 15*a* functions as an evaporator during the cooling main operation mode, the heat exchanger related to heat medium 15*a* may be switched as a condenser, and another second oil collection operation mode may be carried out in which no refrigerant or a reduced rate of flow is made to flow in the heat exchanger related to heat medium 15*b*. For example, as shown in FIG. 12, the second refrigerant flow switching device 18*a* may be switched such that the heat exchanger related to heat medium 15*a* functions as a condenser, and the opening degree of the expansion device 16*b* set to be totally closed or reduced to a sufficiently low opening degree so as to stop or reduce the flow rate of the refrigerant flowing in the heat exchanger related to heat medium 15*b*. In this case, the opening degree of the expansion device 16*b* connected to the heat exchanger related to heat medium 15*b* that had been functioning as a condenser during the heating main operation mode may be stored, the opening degree of the expansion device 16*a* may be set so as to be substantially the same as the opening degree of the expansion device 16*b*, and the opening degree may be fixed while in the second oil collection operation mode. By carrying out the above, there will be no hunting in the expansion device 16, and a stable oil collection operation can be carried out. Since there will be no refrigerant made to flow in the heat exchanger related to heat medium 15*b* with this method, the heat exchanger related to heat medium 15*b* will not function as an evaporator and cool the heat medium, and there will be no waste of heat. With this method, a liquid-back-flow will also occur in the compressor 10, but the operation time is only required to be carried out for a moment of seconds (10 sec, for example), so the liquid refrigerant is stored in the accumulator 19. Accordingly, the amount of liquid refrigerant flowing back to the compressor 10 does not greatly increase, and no problem will occur.

Next, an operation in the cooling only operation mode will be described. In this case, since all of the plate heat exchangers (heat exchangers related to heat medium 15*a* and 15*b*) are functioning as evaporators, all of the plate heat exchangers functioning as evaporators will be made to function as condensers. Here, as same as above, the second oil collection operation mode is carried out in which the plate heat exchangers operating as evaporators (heat exchangers related to heat medium 15*a* and 15*b*) are made to operate as a condenser by sending high-temperature high-pressure refrigerant thereto while the heat source side heat exchanger 12 is operating as a condenser. Specifically, as shown in FIG. 11, while the switching state of the first refrigerant flow switching device 11 is maintained as it is, the switching state of the second refrigerant flow switching devices 18*a* and 18*b* are controlled such that the heat exchangers related to heat medium 15*a* and 15*b* that have been operating as evaporators are made to operate as condensers by sending a high-temperature high-pressure refrigerant therein. In this second oil collection operation mode, all of the heat exchangers related to heat medium 15*a* and 15*b* function as a condenser, and, thus, the refrigerating machine oil in the heat exchangers related to heat medium 15*a* and 15*b* that had been functioning as evaporators during the cooling only operation mode is discharged out of the heat medium relay unit 3 through the on-off device 17*b* and is returned to the compressor 10. In this second oil collection operation mode, since there is no heat exchanger operating as an evaporator, the compressor 10 is in a liquid-back-flowing operation in which the liquid refrigerant back flows thereto. However, the operation time of the second oil collection operation mode is only required to be carried out for a moment of seconds (10 sec, for example), so the liquid refrigerant is stored in the accumulator 19. Accordingly, the amount of liquid refrigerant flowing back to the compressor 10 does not greatly increase, and no problem will occur.

Here, the opening degrees of the expansion devices 16*a* and 16*b* are set to a value that has been stored in the system in advance, and during the second oil collection operation mode, the opening degrees are fixed. This value can be determined, for example, through an experiment that measures the change in high and low pressure during the second oil collection operation mode and measuring the amount of liquid that has back flowed to the accumulator.

Further, as mentioned above, there will be a plate heat exchanger (heat exchanger related to heat medium 15) that operates as an evaporator during the cooling only operation mode, the cooling main operation mode, and the heating main operation mode. Accordingly, the execution timing of the first oil collection operation mode or the second oil collection operation mode are when the elapsed time (the period of time operating as an evaporator) of the cooling only operation mode, the cooling main operation mode, or the heating main operation mode is integrated, and when the integration time reaches a prescribed value (90 min, for example). The first oil collection operation mode or the second oil collection operation mode is executed for a fixed period of time (a few ten seconds 10 sec, for example).

On the other hand, during the heating only operation mode, since all of the plate heat exchangers (heat exchangers related to heat medium 15) are operating as condensers, no refrigerating machine oil will stagnate in the heat exchangers related to heat medium 15. Hence, when operating in the heating only operation mode, the time that has been integrated until then is cleared to nil, and the integration of time will be resumed when in the cooling only operation mode, the cooling main operation, or the heating main operation mode.

It should be noted that although description of the oil collection mode with R410A that changes into two phase on the high-pressure side has been described, refrigerants such as $CO_2$ that turns into a critical state on the high-pressure side can be applied in the same manner, and same effect can be exerted.

Furthermore, since the oil collection mode can collect the refrigerating machine oil with an operation of a moment of seconds, only the refrigerant passage is switched and the heat medium passage is not switched.

As aforedescribed, in the air-conditioning apparatus 100 according to Embodiment, in relation to each operation mode, the oil collection mode is executed that increases the flow velocity of the refrigerant flowing in the heat exchangers related to heat medium 15. Alternatively, in relation to each operation mode, the oil collection modes (first or second oil collection operation mode) are executed that change the flow direction of the refrigerant flowing in the heat exchangers related to heat medium 15. With the above, the refrigerating machine oil stagnating in the heat exchangers related to heat medium 15 can be collected into the compressor. Hence, the amount of refrigerating machine oil that is required in the compressor 10 can be secured, and burn-out due to lack of oil can be prevented.

In addition, when the heat exchanger related to heat medium 15 operates as an evaporator, the refrigerant is made to flow from the lower part of the refrigerant passage and to flow out from the upper part thereof. Accordingly, the ascending energy caused by the floating power of the refrigerant gas can be used, and, thus, conveyance power of the refrigerant can be reduced, increasing the operation efficiency. In addition, when the heat exchanger related to heat medium 15 operates as a condenser, the refrigerant is made to flow from the upper part of the refrigerant passage and to flow out from the lower part thereof. Accordingly, the gravitational potential energy of the falling liquid refrigerant can be used, and, thus, conveyance power of the refrigerant can be reduced, increasing the operation efficiency. Hence, energy saving can be achieved.

Furthermore, in the air-conditioning apparatus 100 according to Embodiment, in the case in which only the heating load or cooling load is generated in the use side heat exchangers 26, the corresponding first heat medium flow switching devices 22 and the corresponding second heat medium flow switching devices 23 are controlled so as to have a medium opening degree, such that the heat medium flows into both of the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Moreover, in the air-conditioning apparatus 100, the outdoor unit 1 and the heat medium relay unit 3 are connected with refrigerant pipings 4 thorough which the heat source side refrigerant flows. The heat medium relay unit 3 and each indoor unit 2 are connected with pipings 5 through which the heat medium flows. Cooling energy or heating energy generated in the outdoor unit 1 exchanges heat in the heat medium relay unit 3, and is delivered to the indoor units 2. Accordingly, the refrigerant does not circulate in or near the indoor units 2, and risk of the refrigerant leaking into the room and the like can be eliminated. Hence, safety is increased.

Furthermore, the heat source side refrigerant and the heat medium exchange heat in the heat medium relay unit 3 that is a separate housing to the outdoor unit 1. Accordingly, the pipings 5 in which the heat medium circulates can be shortened and small conveyance power is required, and thus, safety can be increased and energy can be saved.

The heat medium relay unit 3 and each indoor unit 2 are connected with two pipings 5. Further, passages between each use side heat exchanger 26 in each indoor unit 2 and each heat exchanger related to heat medium 15 housed in the heat medium relay unit 3 are switched according to the operation mode. Because of this, the cooling or heating can be selected per each indoor unit 2 with the connection of the two pipings 5, and, thus, installation work of the pipings in which the heat medium circulates can be facilitated and can be carried out safely.

The outdoor unit 1 and each heat medium relay unit 3 are connected with two refrigerant pipings 4. Because of this, installation work of the refrigerant pipings 4 can be facilitated and can be carried out safely.

Furthermore, the pump 21 is provided per each heat exchanger related to heat medium 15. Because of this, the pump 21 does not need to be provided per each indoor unit 2, and thus an air-conditioning apparatus configured at low cost can be obtained. In addition, noise generated by the pumps can be reduced.

The plurality of use side heat exchangers 26 is each connected in parallel to the heat exchanger related to heat mediums 15 through corresponding first heat medium flow switching devices 22 and second heat medium flow switching devices 23. Because of this, even when a plurality of indoor units 2 are provided, the heat medium that has heat exchanged does not flow into the passage in which the heat medium before heat exchange flows, and thus each indoor unit 2 can exert its maximum capacity. Hence, waste of energy can be reduced and energy saving can be achieved.

Figure 13:
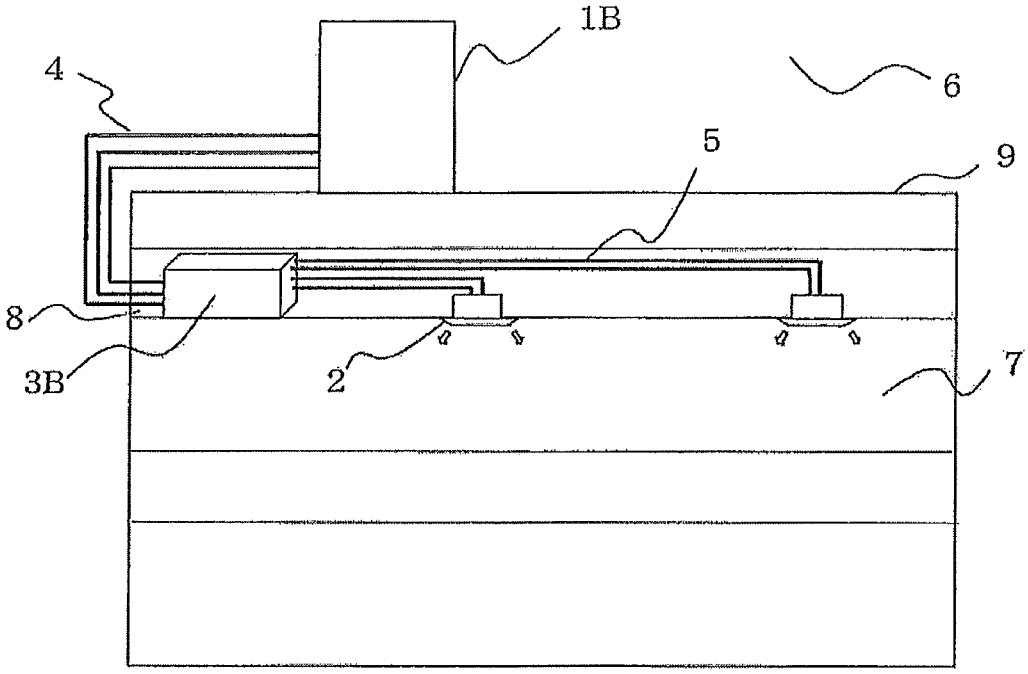
FIG. 13 is a schematic diagram illustrating an exemplary installation of an air-conditioning apparatus according to Embodiment of the invention.
Figure 14:
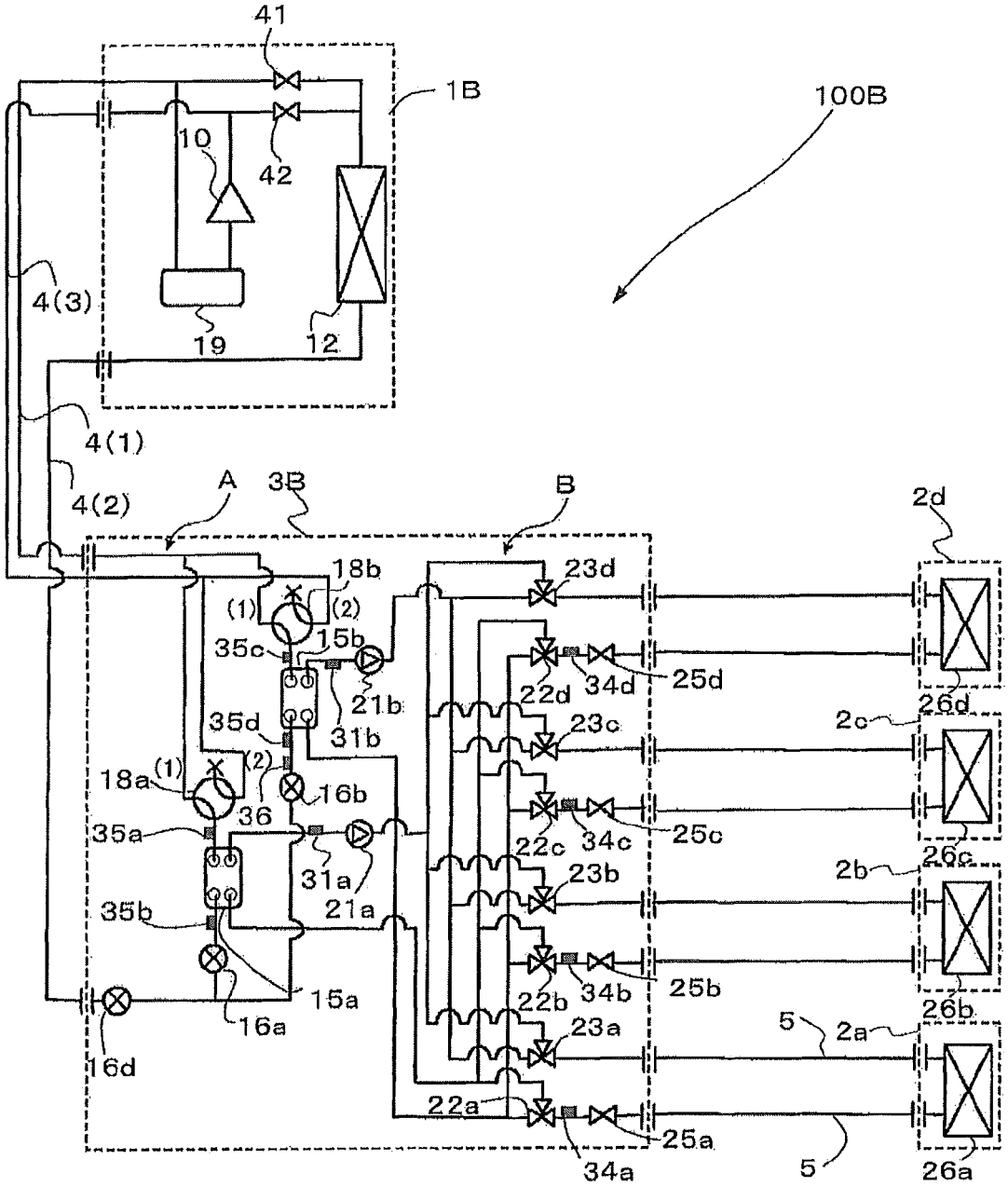
FIG. 14 is a schematic circuit diagram illustrating another exemplary circuit configuration of an air-conditioning apparatus according to Embodiment of the invention.

Furthermore, the air-conditioning apparatus according to Embodiment (hereinafter referred as air-conditioning apparatus 100B) may be configured such that the outdoor unit (hereinafter, referred as outdoor unit 1B) and the heat medium relay unit (hereinafter, referred as heat medium relay unit 3B) are connected with three refrigerant pipings 4 (refrigerant piping 4(1), refrigerant piping 4(2), refrigerant piping 4(3)) as shown in FIG. 14. FIG. 13 illustrates a diagram of an exemplary installation of the air-conditioning apparatus 100B. Specifically, the air-conditioning apparatus 100B also allows all of the indoor units 2 to perform the same operation and allows each of the indoor units 2 to perform different operations. In addition, in the refrigerant piping 4(2) in the heat medium relay unit 3B, an expansion device 16*b* (for example, an electronic expansion valve) is provided for the merging high-pressure liquid during cooling main operation mode.

The general configuration of the air-conditioning apparatus 100B is the same as the air-conditioning apparatus 100 except for the outdoor unit 1B and the heat medium relay unit 3B. The outdoor unit 1B includes a compressor 10, a heat source side heat exchanger 12, an accumulator 19, two flow switching units (flow switching unit 41 and flow switching unit 42). The flow switching unit 41 and the flow switching unit 42 constitute the first refrigerant flow switching device. In the air-conditioning apparatus 100, a case in which the first refrigerant flow switching device is a four-way valve has been described, but as shown in FIG. 14, the first refrigerant switching device may be a combination of a plurality of two-way valves.

In the heat medium relay unit 3B, the refrigerant piping, which is branched from the refrigerant piping 4(2) having the on-off device 17 and is connected to the second refrigerant switching device 18*b*, is not provided and instead the on-off devices 18*a* (1) and 18*b* (1) are connected to the refrigerant piping 4(1), and the on-off devices 18*a* (2) and 18*b* (2) are connected to the refrigerant piping 4(3). Further, the expansion device 16*d* is provided and is connected to the refrigerant piping 4(2).

The refrigerant piping 4(3) connects the discharge piping of the compressor 10 to the heat medium relay unit 3B. The two flow switching units each include, for example, a two-way valve and are configured to open or close the refrigerant piping 4. The flow switching unit 41 is provided between the suction piping of the compressor 10 and the heat source side heat exchanger 12, and the control of its opening and closing switches the refrigerant flow of the heat source refrigerant. The flow switching unit 42 is provided between the discharge piping of the compressor 10 and the heat source side heat exchanger 12, and the control of its opening and closing switches the refrigerant flow of the heat source refrigerant.

Hereinafter, with reference to FIG. 14, each operation mode carried out by the air-conditioning apparatus 100 B will be described. Note that since the heat medium flow in the heat medium circuit B is the same as the air-conditioning apparatus 100, description will be omitted.

[Cooling Only Operation Mode]

In this cooling only operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the flow switching unit 42 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant, which has flowed out of the heat source side heat exchanger 12, passes through the refrigerant piping 4 (2) and flows into the heat medium relay unit 3B. The high-pressure liquid refrigerant flowing into the heat medium relay unit 3B is branched after passing through a fully opened expansion device 16 *d* and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b*, functioning as evaporators, removes heat from the heat medium circulating in a heat medium circuit B to cool the heat medium, and thus turns into a low-temperature low-pressure gas refrigerant. The gas refrigerant, which has flowed out of each of the heat exchanger related to heat medium 15*a* and the heat exchanger related to heat medium 15*b*, merges and flows out of the heat medium relay unit 3B through the corresponding one of a second refrigerant flow switching device 18*a* and a second refrigerant flow switching device 18*b*, passes through the refrigerant piping 4 (1), and again flows into the outdoor unit 1. The refrigerant flowing into the outdoor unit 16, flow through the accumulator 19 and again is sucked into the compressor 10.

[Heating Only Operation Mode]

In this heating only operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the refrigerant piping 4 (3) and out of the outdoor unit 1B. The high-temperature high-pressure gas refrigerant, which has flawed out of the outdoor unit 1B, passes through the refrigerant piping 4 (3) and flows into the heat medium relay unit 3B. The high-temperature high-pressure gas refrigerant that has flowed into to the heat medium relay unit 3B is branched, passes through each of the second refrigerant flow switching device 18*a* and the second refrigerant flow switching device 18*b*, and flows into the corresponding one of the heat exchanger related to heat medium 15*a* and the heat exchanger related to heat medium 15*b*.

The high-temperature high-pressure gas refrigerant flowing into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant through the expansion device 16*a* and the expansion device 16*b*. This two-phase refrigerant passes through the fully-opened expansion device 16*d*, flows out of the heat medium relay unit 3B, passes through the refrigerant piping 4 (2), and again flows into the outdoor unit 1B.

The refrigerant flowing into the outdoor unit 1B flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the flow switching unit 41 and the accumulator 19 and is again sucked into the compressor 10.

[Cooling Main Operation Mode]

The cooling main operation mode will be described with respect to a case in which a cooling load is generated in the use side heat exchanger 26*a* and a heating load is generated in the use side heat exchanger 26*b*. Note that in the cooling main operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. A portion of the high-temperature high-pressure gas refrigerant discharged from the compressor 10 flows through the flow switching unit 42 into the heat source side heat exchanger 12. Then, the refrigerant is condensed into a high-pressure liquid refrigerant while transferring heat to outdoor air in the heat source side heat exchanger 12. The liquid refrigerant, which has flowed out of the heat source side heat exchanger 12, passes through the refrigerant piping 4 (2), flows into the heat medium relay unit 3B, and is slightly decompressed to medium pressure by the expansion device 16*d*. Meanwhile, the remaining high-temperature high-pressure gas refrigerant passes through the refrigerant piping 4 (3) and flows into the heat medium relay unit 3B. The high-temperature high-pressure refrigerant flowing into the heat medium relay unit 3B passes through the second refrigerant flow switching device 18*b*(2) and flows into the heat exchanger related to heat medium 15*b*, functioning as a condenser.

The high-temperature high-pressure gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is slightly decompressed to medium pressure by the expansion device 16*b* and is merged with the liquid refrigerant that has been decompressed to medium pressure by the expansion device 16*d*. The merged refrigerant is expanded by the expansion device 16*a* turning into a low-pressure two-phase refrigerant and flows into the heat exchanger related to heat medium 15*a* functioning as an evaporator. The low-pressure two-phase refrigerant flowing into the heat exchanger related to heat medium 15*a* removes heat from the heat medium circulating in the heat medium circuit B to cool the heat medium, and thus turns into a low-pressure gas refrigerant. This gas refrigerant flows out of the heat exchanger related to heat medium 15*a*, flows through the second refrigerant flow switching device 18*a* out of the heat medium relay unit 3, passes through the refrigerant piping 4 (1), and again flows into the outdoor unit 1. The refrigerant flowing into the outdoor unit 1B, flows through the accumulator 19 and again is sucked into the compressor 10.

[Heating Main Operation Mode]

The heating main operation mode will be described herein with respect to a case in which a heating load is generated in the use side heat exchanger 26*a* and a cooling load is generated in the use side heat exchanger 26*b*. Note that in the heating main operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the refrigerant piping 4 (3) and out of the outdoor unit 1B. The high-temperature high-pressure gas refrigerant, which has flowed out of the outdoor unit 1B, passes through the refrigerant piping 4 (3) and flows into the heat medium relay unit 3B. The high-temperature high-pressure gas refrigerant flowing into the heat medium relay unit 3B passes through the second refrigerant flow switching device 18*b* and flows into the heat exchanger related to heat medium 15*b*, functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant is branched into two, and one portion flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B to evaporate, thus cooling the heat medium. This low-pressure two-phase refrigerant flows out of the heat exchanger related to heat medium 15*a*, turns into a low-temperature low-pressure gas refrigerant, passes through the second refrigerant flow switching device 18*a*(1), flows out of the heat medium relay unit 3B, passes through the refrigerant piping 4(1), and again flows into the outdoor unit 1. The two-phase low-pressure refrigerant, which had been branched after flowing through the expansion device 16*b*, passes through the fully-opened expansion device 16*d*, flows out of the heat medium relay unit 3B, passes through the refrigerant piping 4 (2), and flows into the outdoor unit 1B.

The refrigerant flowing through the refrigerant piping 4(2) and into the outdoor unit 1B flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant that has flowed out of the heat source side heat exchanger 12 flows through the flow switching unit 41, merges with the low-temperature low-pressure gas refrigerant that has flowed into the outdoor unit 1B through the refrigerant piping 4(1), flows through the accumulator 19, and again is sucked into the compressor 10.

Furthermore, each of the first heat medium flow switching devices 22 and the second heat medium flow switching devices 23 described in Embodiment may be any of the sort as long as they can switch passages, for example, a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case in which the heat medium flow control devices 25 each include a stepping-motor-driven two-way valve, each of the heat medium flow control devices 25 may include a control valve having three passages and the valve may be disposed with a bypass pipe that bypasses the corresponding use side heat exchanger 26.

Furthermore, as regards each of the heat medium flow control device 25, a stepping-motor-driven type that is capable of controlling a flow rate in the passage may be used. Alternatively, a two-way valve or a three-way valve whose one end is closed may be used. Alternatively, as regards each of the heat medium flow control device 25, a component, such as an on-off valve, which is capable of opening or closing a two-way passage, may be used while ON and OFF operations are repeated to control an average flow rate.

Furthermore, while the case in which each second refrigerant flow switching device 18 is a four-way valve has been described, the device is not limited to this type. The device may be configured such that the refrigerant flows in the same manner using a plurality of two-way flow switching valves or three-way flow switching valves.

While the air-conditioning apparatus 100 according to Embodiment has been described with respect to the case in which the apparatus can perform the cooling and heating mixed operation, the apparatus is not limited to the case. Even in an apparatus that is configured by a single heat exchanger related to heat medium 15 and a single expansion device 16 that are connected to a plurality of parallel use side heat exchangers 26 and heat medium flow control devices 25, and even in an apparatus that is only capable of carrying out a cooling operation or a heating operation, the same advantages can be obtained.

In addition, it is needless to say that the same holds true for the case in which only a single use side heat exchanger 26 and a single heat medium flow control device 25 are connected. Moreover, obviously, no problem will arise even if the heat exchanger related to heat medium 15 and the expansion device 16 acting in the same manner are arranged in plural numbers. Furthermore, while the case in which the heat medium flow control devices 25 are equipped in the heat medium relay unit 3 has been described, the arrangement is not limited to this case. Each heat medium flaw control device 25 may be disposed in the indoor unit 2. The heat medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat medium 15*a* or the heat exchanger related to heat medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

While Embodiment has been described with respect to the case in which the air-conditioning apparatus 100 includes the accumulator 19, the accumulator 19 may be omitted. In addition, while Embodiment has been described with respect to the case in which the air-conditioning apparatus 100 includes the check valves 13*a* to 13*d*, these components are not essential parts. It is therefore needless to say that even if the accumulator 19 and the check valves 13*a* to 13*d* are omitted, the air-conditioning apparatus will act in the same manner and offer the same advantages.

Typically, a heat source side heat exchanger 12 and a use side heat exchanger 26 is provided with a blower in which a current of air often facilitates condensation or evaporation. The structure is not limited to this case. For example, a heat exchanger, such as a panel heater, using radiation can be used as the use side heat exchanger 26 and a water-cooled heat exchanger that transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26. The number of the use side heat exchanger 26 is not particularly limited.

Embodiment has been described with respect to the case in which a single first heat medium flow switching device 22, a single second heat medium flow switching device 23, and a single heat medium flow control device 25 are connected to each use side heat exchanger 26. The arrangement is not limited to this case. A plurality of devices 22, a plurality of devices 23, and a plurality of devices 25 may be connected to each use side heat exchanger 26. In this case, the first heat medium flow switching devices, the second heat medium flow switching devices, and the heat medium flow control devices connected to the same use side heat exchanger 26 may be operated in the same manner.

Furthermore, Embodiment has been described with respect to the case in which the number of heat exchangers related to heat medium 15 is two. As a matter of course, the arrangement is not limited to this case. As long as the heat exchanger related to heat medium 15 is configured to be capable of cooling or/and heating the heat medium, the number of heat exchangers related to heat medium 15 arranged is not limited.

Furthermore, each of the number of pumps 21*a* and that of pumps 21*b* is not limited to one. A plurality of pumps having a small capacity may be used in parallel.

As described above, the air-conditioning apparatus 100 according to Embodiment can perform a safe and high energy-saving operation by controlling the heat medium flow switching devices (the first heat medium flow switching devices 22 and the second heat medium flow switching devices 23), the heat medium flow control devices 25, and the pumps 21 for the heat medium.

REFERENCE SIGNS LIST

1 outdoor unit, 1B outdoor unit, 2 indoor unit, 2*a* indoor unit, 2*b* indoor unit, 2*c* indoor unit, 2*d* indoor unit, 3 heat medium relay unit, 3B heat medium relay unit, 3*a* main-heat medium relay unit, 3*b* sub-heat medium relay unit, 4 refrigerant piping, 4*a* first connection piping, 4*b* second connection piping, 5 piping, 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 14 gas-liquid separator, 15 heat exchanger related to heat medium, 15*a* heat exchanger related to heat medium, 15*b* heat exchanger related to heat medium, 16 expansion device, 16*a* expansion device, 16*b* expansion device, 16*c* expansion device, 16*d* expansion device, 17 on-off device, 17*a* on-off device, 17*b* on-off device, 18 second refrigerant flow switching device, 18*a* second refrigerant flow switching device, 18*b* second refrigerant flow switching device, 19 accumulator, 21 pump, 21*a* pump, 21*b* pump, 22 first heat medium flow switching device, 22*a* first heat medium flow switching device, 22*b* first heat medium flow switching device, 22*c* first heat medium flow switching device, 22*d* first heat medium flow switching device, 23 second heat medium flow switching device, 23*a* second heat medium flow switching device, 23*b* second heat medium flow switching device, 23*c* second heat medium flow switching device, 23*d* second heat medium flow switching device, 25 heat medium flow control device, 25*a* heat medium flow control device, 25*b* heat medium flow control device, 25*c* heat medium flow control device, 25*d* heat medium flow control device, 26 use side heat exchanger, 26*a* use side heat exchanger, 26*b* use side heat exchanger, 26*c* use side heat exchanger, 26*d* use side heat exchanger, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 41 flow switching unit, 42 flow switching unit, 100 air-conditioning apparatus, 100A air-conditioning apparatus, 100B air-conditioning apparatus, A refrigerant circuit, B heat medium circuit

The invention claimed is:

1. An air-conditioning apparatus, comprising:

a compressor, a heat source side heat exchanger, a plurality of expansion devices, a plurality of heat exchangers related to heat medium, a plurality of pumps, and a plurality of use side heat exchangers, wherein a refrigerant circuit circulating a refrigerant that contains a refrigerating machine oil therein is formed by connecting the compressor, the heat source side heat exchanger, the expansion devices, and the heat exchangers related to heat medium with a refrigerant piping, a plurality of heat medium circuits circulating a heat medium are formed by connecting the pumps, the use side heat exchangers, and the heat exchangers related to heat medium, the air-conditioning apparatus is capable of executing:

a heating only operation mode that heats the heat medium by making high-temperature high-pressure refrigerant flow into all of the heat exchangers related to heat medium;

a cooling only operation mode that cools the heat medium by making low-temperature low-pressure refrigerant flow into all of the heat exchangers related to heat medium;

a cooling and heating mixed operation mode that heats the heat medium by making high-temperature high-pressure refrigerant flow into one or some of the heat exchangers related to heat medium and cools the heat medium by making low-temperature low-pressure refrigerant flow into one or some of the remaining heat exchangers related to heat medium; and an oil collection mode that collects the refrigerating machine oil stagnating in the heat exchangers related to heat medium into the compressor by changing a flow velocity or a flow direction of the refrigerant flowing in the heat exchangers related to heat medium depending on each operation mode, wherein the air-conditioning apparatus further includes:

a first refrigerant flow switching device that switches passages of the refrigerant that is discharged or sucked into the compressor, and a plurality of second refrigerant flow switching devices respectively disposed for the heat exchangers related to heat medium, the second refrigerant flow switching devices each switching passages of the refrigerant that flows into or flows out of the corresponding heat exchanger related to heat medium, and wherein in the oil collection mode, while the switching state of the first refrigerant flow switching device is maintained as it is, the switching state of the second refrigerant flow switching devices is switched such that at least one heat exchanger related to heat medium operates as an evaporator, in which the low-temperature low-pressure refrigerant flow operates as a condenser or a gas cooler by sending the high-temperature high-pressure refrigerant therein.

2. The air-conditioning apparatus of claim 1, wherein each of the heat exchangers related to heat medium:

has a refrigerant side passage formed therein, in which the refrigerant flows to exchange heat with the heat medium, is arranged such that the refrigerant flows in the refrigerant side passage from a lower part to an upper part at a vertical angle or an angle larger than the horizontal angle when the low-temperature low-pressure refrigerant flows in the refrigerant side passage and when each of the heat exchangers related to heat medium operates as an evaporator, and is arranged such that the refrigerant flows in the refrigerant side passage from the upper part to the lower part at a vertical angle or an angle larger than the horizontal angle when the high-temperature high-pressure refrigerant flows in the refrigerant side passage and when each of the heat exchangers related to heat medium operates as a condenser or a gas cooler.

3. The air-conditioning apparatus of claim 1, wherein:

serial connection and parallel connection among the heat exchangers related to heat medium are switched by controlling the switching state of the plurality of second refrigerant flow switching devices, the plurality of expansion devices are provided with the heat exchangers related to heat medium, respectively, a heating main operation mode is executed, as the cooling and heating mixed operation mode, which is executed by switching the plurality of heat exchangers related to heat medium into serial connection, and while the low-temperature low-pressure refrigerant is made to flow in the heat source side heat exchanger, one or some of the heat exchangers related to heat medium where the high-temperature high-pressure refrigerant flows operate as condensers or gas coolers to heat the heat medium and one or some of the remaining heat exchangers related to heat medium where the low-temperature low-pressure refrigerant flows operate as evaporators to cool the heat medium; and a first oil collection operation mode is executed, as the oil collection mode, which is executed by switching the plurality of heat exchangers related to heat medium into parallel connection and controlling each opening degree of the plurality of expansion devices, and while the low-temperature low-pressure refrigerant is made to flow in the heat source side heat exchanger, at least one heat exchanger related to heat medium operates as an evaporator, in which the high-temperature high-pressure refrigerant flows-operates as a condenser or a gas cooler.

4. The air-conditioning apparatus of claim 1, serial connection and parallel connection among the heat exchangers related to heat medium are switched by controlling the switching state of the plurality of second refrigerant flow switching devices, the plurality of expansion devices are provided with the heat exchangers related to heat medium, respectively, a cooling main operation mode is executed as the cooling and heating mixed operation mode, which is executed by switching the plurality of heat exchangers related to heat medium into serial connection, and while the high-temperature high-pressure refrigerant is made to flow in the heat source side heat exchanger, one or some of the heat exchangers related to heat medium where the high-temperature high-pressure refrigerant flows operate as condensers or gas coolers to heat the heat medium and one or some of the remaining heat exchangers related to heat medium where the low-temperature low-pressure refrigerant flows operate as evaporators to cool the heat medium; and a second oil collection operation mode is executed, as the oil collection mode, which is executed by switching the plurality of heat exchangers related to heat medium into parallel connection and controlling each opening degree of the plurality of expansion devices, and while the high-temperature high-pressure refrigerant is made to flow in the heat source side heat exchanger, at least one heat exchanger related to heat medium operates as an evaporator, in which the high-temperature high-pressure refrigerant flows operates as a condenser or a gas cooler.

5. The air-conditioning apparatus of claim 1, wherein the refrigerant is made to circulate such that the high-temperature high-pressure refrigerant and the heat medium, both flowing in the heat exchangers related to heat medium heating the heat medium, counterflow, and the refrigerant is made to circulate such that the low-temperature low-pressure refrigerant and the heat medium, both flowing in the heat exchangers related to heat medium cooling the heat medium, flow in parallel.

6. The air-conditioning apparatus of claim 3, wherein in the first oil collection operation mode, while the low-temperature low-pressure refrigerant is made to flow in the heat source side heat exchanger, a heat exchanger related to heat medium operating as an evaporator operates as a condenser or a gas cooler by flowing the high-temperature high-pressure refrigerant therein and a flow of the refrigerant is stopped or a flow rate of the refrigerant is reduced, the refrigerant flowing into a heat exchanger related to heat medium operates as a condenser or a gas cooler out of the heat exchangers related to heat medium.

7. The air-conditioning apparatus of claim 3, wherein in the first oil collection operation mode, each opening degree of the expansion devices respectively connected to the one or some of the heat exchangers related to heat medium that had been operating as evaporators during the heating main operation mode is set to have an opening degree based on every opening degree of the expansion devices respectively connected to the one or some of the heat exchangers related to heat medium that had been operating as condensers or gas coolers during the heating main operation mode.

8. The air-conditioning apparatus of claim 4, wherein in the second oil collection operation mode, while the high-temperature high-pressure refrigerant is made to flow in the heat source side heat exchanger, a heat exchanger related to heat medium operating as an evaporator out of the heat exchangers related to heat medium operates as a condenser or a gas cooler by flowing the high-temperature high-pressure refrigerant therein, and a flow of the refrigerant is stopped or a flow rate of the refrigerant is reduced, the refrigerant flowing into a heat exchanger related to heat medium operates as a condenser or a gas cooler out of the heat exchangers related to heat medium.

9. The air-conditioning apparatus of claim 4, wherein in the second oil collection operation mode, each opening degree of the expansion devices respectively connected to the one or some of the heat exchangers related to heat medium that had been operating as evaporators during the cooling main operation mode is set to have an opening degree based on every opening degree of the expansion devices respectively connected to the one or some of the heat exchangers related to heat medium that had been operating as condensers or gas coolers during the cooling main operation mode.

10. An air-conditioning apparatus, comprising:

a compressor; a heat source side heat exchanger; a plurality of expansion devices; a plurality of heat exchangers related to heat medium; a plurality of pumps; and a plurality of use side heat exchangers, wherein a refrigerant circuit circulating a refrigerant that contains a refrigerating machine oil therein is formed by connecting the compressor, the heat source side heat exchanger, the expansion devices, and the heat exchangers related to heat medium with a refrigerant piping, a plurality of heat medium circuits circulating a heat medium are formed by connecting the pumps, the use side heat exchangers, and the heat exchangers related to heat medium, and the air-conditioning apparatus is capable of executing:

a heating only operation mode that heats the heat medium by making high-temperature high-pressure refrigerant flow into all of the heat exchangers related to heat medium;

a cooling only operation mode that cools the heat medium by making low-temperature low-pressure refrigerant flow into all of the heat exchangers related to heat medium;

a cooling and heating mixed operation mode that heats the heat medium by making high-temperature high-pressure refrigerant flow into one or some of the heat exchangers related to heat medium and cools the heat medium by making low-temperature low-pressure refrigerant flow into one or some of the remaining heat exchangers related to heat medium; and an oil collection mode that collects the refrigerating machine oil stagnating in the heat exchangers related to heat medium into the compressor by changing a flow velocity or a flow direction of the refrigerant flowing in the heat exchangers related to heat medium depending on each operation mode, wherein the air-conditioning apparatus further includes:

a plurality of second refrigerant flow switching devices respectively disposed for the heat exchangers related to heat medium, the second refrigerant flow switching devices each switching passages of the refrigerant that flows into or flows out of the corresponding heat exchanger related to heat medium, and wherein serial connection and parallel connection among the heat exchangers related to heat medium are switched by controlling the switching state of the plurality of second refrigerant flow switching devices, in the oil collection mode, the plurality of heat exchangers related to heat medium are switched into serial connection such that one or some of the heat exchangers related to heat medium, in which the low-temperature low-pressure refrigerant flows, operate as evaporators and such that one or some of the remaining heat exchangers related to heat medium, in which the high-temperature high-pressure refrigerant flows, operate as condensers, and at least one opening degree of the plurality of expansion devices is made larger than the opening degree before the execution of the oil collection mode.

11. The air-conditioning apparatus of claim 10, being capable of executing a cooling main operation mode and a heating main operation mode as the cooling and heating mixed operation mode, in the cooling main operation mode, the high-temperature high-pressure refrigerant is made to flow into one or some of the heat exchangers related to heat medium to heat the heat medium and the low-temperature low-pressure refrigerant is made to flow into one or some of the remaining heat exchangers related to heat medium to cool the heat medium while the high-temperature high-pressure refrigerant is made to flow in the heat source side heat exchanger, in the heating main operation mode, the high-temperature high-pressure refrigerant is made to flow into one or some of the heat exchangers related to heat medium to heat the heat medium and the low-temperature low-pressure refrigerant is made to flow into one or some of the remaining heat exchangers related to heat medium to cool the heat medium while the low-temperature low-pressure refrigerant is made to flow in the heat source side heat exchanger, wherein the oil collection mode, when an integration time during operation in the heating main operation mode or the cooling main operation mode reaches a prescribed value, is executed for a fixed period of time with each opening degree of the expansion devices larger than an opening degree before the execution of the oil collecting mode to increase a flow velocity of the refrigerant flowing in the heat exchangers related to heat medium and to collect the refrigerating machine oil stagnating in the heat exchangers related to heat medium into the compressor.

12. The air-conditioning apparatus of claim 10, being capable of executing a cooling main operation mode as the cooling and heating mixed operation mode, in the cooling main operation mode, the high-temperature high-pressure refrigerant is made to flow into one or some of the heat exchangers related to heat medium to heat the heat medium and the low-temperature low-pressure refrigerant is made to flow into one or some of the remaining heat exchangers related to heat medium to cool the heat medium while the high-temperature high-pressure refrigerant is made to flow in the heat source side heat exchanger, wherein in the oil collection mode, when an integration time during operation in the cooling main operation mode reaches a prescribed value, the opening degree of the expansion devices is set to be larger than an opening degree before the execution of the oil collecting mode for a fixed period of time to increase a flow velocity of the refrigerant flowing in the heat exchangers related to heat medium and to collect the refrigerating machine oil stagnating in the heat exchangers related to heat medium into the compressor, when the integration time of the operation time reaches a prescribed value during the cooling only operation mode, the refrigerant passage is switched to the same passage as that in the cooling main operation mode, the opening degree of the expansion devices is set to be larger than an opening degree before the execution of the oil collection mode such that the operation is running for a fixed period of time, the flow velocity of the refrigerant flowing in the heat exchangers related to heat medium is increased, and the refrigerating machine oil stagnating in the heat exchangers related to heat medium is collected into the compressor.

13. The air-conditioning apparatus of claim 10, being capable of executing a heating main operation mode as the cooling and heating mixed operation mode, in the heating main operation mode, the high-temperature high-pressure refrigerant is made to flow into one or some of the heat exchangers related to heat medium to heat the heat medium and the low-temperature low-pressure refrigerant is made to flow into one or some of the remaining heat exchangers related to heat medium to cool the heat medium while the low-temperature low-pressure refrigerant is made to flow in the heat source side heat exchanger, wherein in the oil collection mode, when an integration time during operation in the heating main operation mode reaches a prescribed value, the opening degree of the expansion devices is set to be larger than an opening degree before the execution of the oil collecting mode for a fixed period of time to increase a flow velocity of the refrigerant flowing in the heat exchangers related to heat medium and to collect the refrigerating machine oil stagnating in the heat exchangers related to heat medium into the compressor, when the integration time of the operation time reaches a prescribed value during the heating only operation mode, the refrigerant passage is switched to the same passage as that in the heating main operation mode, the opening degree of the expansion devices is set to be larger than an opening degree before the execution of the oil collection mode such that the operation is running for a fixed period of time, the flow velocity of the refrigerant flowing in the heat exchangers related to heat medium to be increased, and the refrigerating machine oil stagnating in the heat exchangers related to heat medium is collected into the compressor.

14. An air-conditioning apparatus, comprising:

a compressor, a heat source side heat exchanger, a plurality of expansion devices, a plurality of heat exchangers related to heat medium, a plurality of pumps, and a plurality of use side heat exchangers, wherein a refrigerant circuit circulating a refrigerant that contains a refrigerating machine oil therein is formed by connecting the compressor, the heat source side heat exchanger, the expansion devices, and the heat exchangers related to heat medium with a refrigerant piping, a plurality of heat medium circuits circulating a heat medium are formed by connecting the pumps, the use side heat exchangers, and the heat exchangers related to heat medium, the air-conditioning apparatus is capable of executing:

a heating only operation mode that heats the heat medium by making high-temperature high-pressure refrigerant flow into all of the heat exchangers related to heat medium;

a cooling only operation mode that cools the heat medium by making low-temperature low-pressure refrigerant flow into all of the heat exchangers related to heat medium;

a cooling and heating mixed operation mode that heats the heat medium by making high-temperature high-pressure refrigerant flow into one or some of the heat exchangers related to heat medium and cools the heat medium by making low-temperature low-pressure refrigerant flow into one or some of the remaining heat exchangers related to heat medium; and an oil collection mode that collects the refrigerating machine oil stagnating in the heat exchangers related to heat medium into the compressor by changing a flow velocity or a flow direction of the refrigerant flowing in the heat exchangers related to heat medium depending on each operation mode; and wherein in the oil collection mode, when the integration time of the operation time reaches a prescribed value during the heating only operation mode or the cooling only operation mode, each opening degree of the expansion devices corresponding to the one or some of the heat exchangers related to heat medium is set to be larger than an opening degree before the execution of the oil collection mode, and each opening degree of the expansion devices corresponding to the one or some of the remaining heat exchangers related to heat medium is set to be smaller than an opening degree before the execution of the oil collection mode or is set to be closed such that the operation is running for a fixed period of time, and the refrigerating machine oil stagnating in the one or some of the heat exchangers related to heat medium is collected into the compressor by increasing the flow velocity of the refrigerant flowing in the one or some of the heat exchangers related to heat medium.

* * * * *